US009151038B2

(12) United States Patent
Zimmerman et al.

(10) Patent No.: US 9,151,038 B2
(45) Date of Patent: Oct. 6, 2015

(54) ANCHOR BOLT DEVICES AND OPERATING METHODS FOR RESIDENTIAL AND COMMERCIAL STRUCTURES

(75) Inventors: Steven Zimmerman, Linden, AL (US); Van T. Walworth, Lebanon, TN (US); Thomas J. DuPuy, Lebanon, TN (US)

(73) Assignee: SR Systems, LLC, Tuscaloosa, AL (US)

( * ) Notice: Subject to any disclaimer, the term of this patent is extended or adjusted under 35 U.S.C. 154(b) by 144 days.

(21) Appl. No.: 13/613,127

(22) Filed: Sep. 13, 2012

(65) Prior Publication Data

US 2013/0067831 A1 Mar. 21, 2013

Related U.S. Application Data

(60) Provisional application No. 61/685,788, filed on Mar. 26, 2012, provisional application No. 61/685,790, filed on Mar. 26, 2012, provisional application No. 61/685,792, filed on Mar. 26, 2012, provisional application No. 61/685,796, filed on Mar. 26, 2012, provisional application No. 61/573,943, filed on Sep. 15, 2011.

(51) Int. Cl.
*E04B 1/41* (2006.01)
*E04G 21/18* (2006.01)

(52) U.S. Cl.
CPC ..... *E04B 1/4121* (2013.01); *E04B 1/41* (2013.01); *E04B 1/4114* (2013.01); *E04B 1/4157* (2013.01); *E04G 21/185* (2013.01)

(58) Field of Classification Search
CPC ..... E04B 1/10; E04B 1/41; E04B 1/4114; E04B 1/4121; E04B 1/4157; E04G 21/185
USPC ..... 52/98, 100, 105, 704, 707, 698, 701
See application file for complete search history.

(56) References Cited

U.S. PATENT DOCUMENTS 3,300,929 A * 1/1967 Fischer ..... 52/309.1
3,552,734 A * 1/1971 Severino et al. ..... 269/287

(Continued)

FOREIGN PATENT DOCUMENTS

| | | |
|---|---|---|
| EP | 2339186 | 6/2011 |
| JP | 2001-317061 | 11/2001 |
| JP | 2003-343017 | 12/2003 |

OTHER PUBLICATIONS

International Search Report of the International Searching Authority for Application No. PCT/US2012/055802, mailed Mar. 25, 2013.

(Continued)

*Primary Examiner* — Adriana Figueroa
*Assistant Examiner* — Jessie Fonseca
(74) *Attorney, Agent, or Firm* — Harness, Dickey & Pierce, P.L.C.

(57) ABSTRACT

An anchor bolt device includes an anchor bolt having a threaded first end and a second end. A flange portion has the threaded first end of the anchor bolt extending freely therefrom. The flange portion defines a planar surface aligned in parallel with a surface of a concrete foundation when the second end of the anchor bolt is received in the concrete foundation. A raised column projection having a threaded portion through which the threaded first end of the anchor bolt is threadably received. The raised column projection is set to a user defined position. The flange portion extends radially outward from and is integrally connected to the raised column projection. The flange portion has at least one offset tab used to position the device a defined distance away from a boundary of a concrete foundation wall. The offset tab includes a series of marks defining multiple break points.

21 Claims, 32 Drawing Sheets

(56) References Cited

U.S. PATENT DOCUMENTS

| | | | | |
|---|---|---|---|---|
| 4,037,384 | A | 7/1977 | Molyneux | |
| 4,117,643 | A * | 10/1978 | Lamothe | 52/699 |
| 4,872,298 | A | 10/1989 | Klemic | |
| 5,050,364 | A | 9/1991 | Johnson et al. | |
| 5,060,436 | A * | 10/1991 | Delgado, Jr. | 52/295 |
| 5,240,224 | A | 8/1993 | Adams | |
| 5,315,800 | A * | 5/1994 | Weber et al. | 52/309.1 |
| 5,317,850 | A | 6/1994 | Colonias et al. | |
| 5,388,804 | A | 2/1995 | Cohen et al. | |
| 5,836,132 | A | 11/1998 | Weathersby | |
| 6,065,730 | A | 5/2000 | Marks et al. | |
| 6,105,332 | A * | 8/2000 | Boyadjian | 52/698 |
| 6,347,916 | B1 | 2/2002 | Ramirez | |
| 6,431,517 | B1 * | 8/2002 | Chapman | 249/93 |
| 6,922,968 | B1 | 8/2005 | Behlen | |
| 7,076,924 | B2 * | 7/2006 | Thompson | 52/100 |
| 7,103,984 | B2 | 9/2006 | Kastberg | |
| 7,174,689 | B2 | 2/2007 | Alyea et al. | |
| 7,225,589 | B1 * | 6/2007 | Smith | 52/292 |
| 7,445,192 | B2 | 11/2008 | Gridley et al. | |
| 7,448,172 | B1 | 11/2008 | Knodel | |
| 7,520,102 | B1 * | 4/2009 | diGirolamo et al. | 52/741.13 |
| 7,891,110 | B2 | 2/2011 | Diaz | |
| 2005/0120665 | A1 * | 6/2005 | Anderson, Jr. | 52/698 |
| 2005/0120666 | A1 * | 6/2005 | Alyea et al. | 52/698 |
| 2006/0016140 | A1 * | 1/2006 | Smith | 52/295 |
| 2007/0258792 | A1 * | 11/2007 | Pavlov | 411/439 |
| 2008/0253830 | A1 | 10/2008 | Katsuki | |

OTHER PUBLICATIONS

Written Opinion of the International Searching Authority for Application No. PCT/US2012/055802, mailed Mar. 25, 2013.

* cited by examiner

Section A - A

ANCHOR BOLT DEVICES AND OPERATING METHODS FOR RESIDENTIAL AND COMMERCIAL STRUCTURES

CROSS-REFERENCE TO RELATED APPLICATIONS

This application claims the benefit of U.S. Provisional Application No. 61/685,790, filed on Mar. 26, 2012, U.S. Provisional Application No. 61/685,788, filed on Mar. 26, 2012, U.S. Provisional Application No. 61/685,792, filed on Mar. 26, 2012, and U.S. Provisional Application No. 61/685,796, filed on Mar. 26, 2012, which each claim the benefit of U.S. Provisional Application No. 61/573,943, filed on Sep. 15, 2011. The disclosures of each of the above applications are incorporated herein by reference.

FIELD

The present disclosure relates to anchor bolt devices used to anchor building structures to foundations.

BACKGROUND

This section provides background information related to the present disclosure which is not necessarily prior art.

There are numerous patents in the records that deal with various hurricane or tornado storm wind forces by claiming use of any one of several strengthening components. The prior examples do not lend themselves to our do-it-yourself culture and do not lend themselves to be cost effective for the mass consumption public at large.

There are also some references to prior claims related to improved structures that minimize water influent damage, but again, none of these prior examples lend themselves to our do-it-yourself culture and do not lend themselves to be cost effective for the mass consumption public at large.

There are a numerous patents in the records that deal with the orientation of anchor bolts and various devices designed to position the anchor bolts in concrete slurry. Most of the art patents relate to a template design and method wherein a device is secured to the frame work forms which the concrete slurry will be poured into. The template is fastened to the forms and extends out over the open space the concrete will be poured into whereupon an anchor bolt is affixed thereon and suspended in the open space positioned such that slurry can be poured around it.

Examples of template designs and methods in the art can be seen in U.S. Pat. Nos. 7,448,172; 7,445,192; 6,065,730; 5,836,132; 5,388,804; 5,240,224; 5,060,436; 7,891,110; 4,872,298; 7,103,984; and 6,922,968. These art examples and others like them must be secured to the concrete forms prior to pouring the concrete slurry. As a result they are generally bulky and awkward to use. Furthermore, template style devices do not provide a practical method of orienting and/or positioning an anchor bolt anywhere in the concrete slurry except very close and adjacent to the forms built to retain and confine the slurry.

Furthermore, it is well known by those in the concrete pouring industry that the concrete slurry possesses an inherent force that is imparted upon any and all objects the slurry flow comes in contact with. For example, all of the steel reinforced rebar and suspended anchor bolts and plumbing pipes set in the flow path of the concrete slurry are subjected to the lateral forces imparted upon them by the concrete slurry, often causing the objects to move, break, and/or end up in a different position and/or orientation after the concrete cures and hardens. It therefore becomes a difficult and time consuming and aggravating issue for the contractor to make sure that all of the objects in the concrete slurry maintain their proper position and orientation during and after the pour of the slurry.

Another U.S. Pat. No. 5,317,850 discloses and claims a special bent anchor bolt designed to position itself in cooperation with reinforced rebar positioned in the open space wherein concrete slurry will be poured. This patent is also subjected to the flow forces that concrete slurry impose upon objects in the open space. This patent also requires a special shaped anchor bolt and does not provide any provisions for using a typical anchor bolt structure. Furthermore, this special bent anchor bolt device does not provide a practical method of orienting and/or positioning an anchor bolt anywhere in the concrete slurry except very close and adjacent to the forms built to retain and confine the slurry.

Another U.S. Pat. No. 5,050,364 discloses and claims a holder for an anchor bolt that is positioned and/or fastened to the floor of the open space the concrete slurry will poured into. The holder supports and holds the anchor bolt in the open space. This patent is also subjected to the flow forces that concrete slurry impose upon objects in the open space.

Yet another U.S. Pat. No. 6,347,916 discloses and claims a protective cover assembled over a typical anchor bolt that is designed to cover and protect all the exposed threads of the anchor bolt as it protrudes out of the poured concrete. This patent teaches that the device is set into the slurry after it is poured. Legs are provided to secure a portion of the assembly to the concrete while the protective cover can be removed by the contractor to reveal the threads when time comes to attach a wall construction to the anchor bolts. While these devices may not be subjected to the flow forces inherent in concrete slurry, it is incumbent upon the contractor to remove a protective cover in order to expose the threads and attach a wall construction to the protruding anchor bolts. The difficulty and inconvenience of separating the protective cover portion of the device from the secured legs portion of the device provides an unnecessary effort and source of aggravation and excess time to the contractor.

Yet another U.S. Pat. No. 7,174,689 discloses and claims a protective cover assembled over a typical anchor bolt that is designed to cover and protect all the exposed threads of the anchor bolt as it protrudes out of the poured concrete. The protective cover is designed to set on a base plate template holding the anchor bolt. The protective cover is removed prior to installing a wall construction over the protruding anchor bolt. The base plate template remains in place in the concrete slurry. The assembly is set into the slurry after it is poured. While this device may not be subjected to the flow forces inherent in concrete slurry, it is incumbent upon the contractor to remove a protective cover in order to expose the threads and attach a wall construction to the protruding anchor bolts. The difficulty and inconvenience of separating the protective cover portion of the device from the embedded portion of the device provides an unnecessary effort and source of aggravation and excess time to the contractor.

SUMMARY

This section provides a general summary of the disclosure, and is not a comprehensive disclosure of its full scope or all of its features.

It is an objective of the subject invention to provide an improved system for a typical residential or commercial structure wherein a series of specialized components are integrated together so as to enhance the structural integrity of the structure against wind forces such as those associated with hurricanes and/or tornados.

The subject invention overcomes the shortcomings and problems of the art and provides improved features for positioning and maintaining the position of a typical anchor bolt in a concrete slurry. Those skilled in the art will appreciate and understand the advantages of the subject invention as it is disclosed herein.

Another objective of the subject invention is to provide an improved system for a typical residential or commercial structure wherein a series of specialized components are integrated together so as to enhance the structural integrity of the structure against wind forces, such as those associated with hurricanes and/or tornados, so as to provide a temporary relatively watertight seal for the structure even in the event that the shingles and/or siding is compromised, damaged, or removed by the storm winds. As a result, the shingles and siding provide a cosmetic covering and a primary water seal for the structure; however, the subject invention provides a temporary secondary water seal in the event that the primary seal system is compromised during storm wind exposure.

Another objective of the subject invention is to provide an improved and expanded fracture cone over the tail of anchor bolts. There is a defined fracture cone in the concrete above the tail of an anchor bolt which resists pull-out of the anchor bolt. The subject invention provides an improved anchor assembly enlarging the fracture cone which increases the resistance to pull-out forces.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Embodiment 1

According to several aspects of the subject disclosure an improved device and an improved method for using the device to orient and position a typical anchor bolt in concrete slurry and then maintain that position until the slurry has hardened is provided. The device and method further provides improved means of protecting the threaded portion of the exposed anchor bolt until such time that a wall construction is attached to the anchor bolt.

Figure 1:
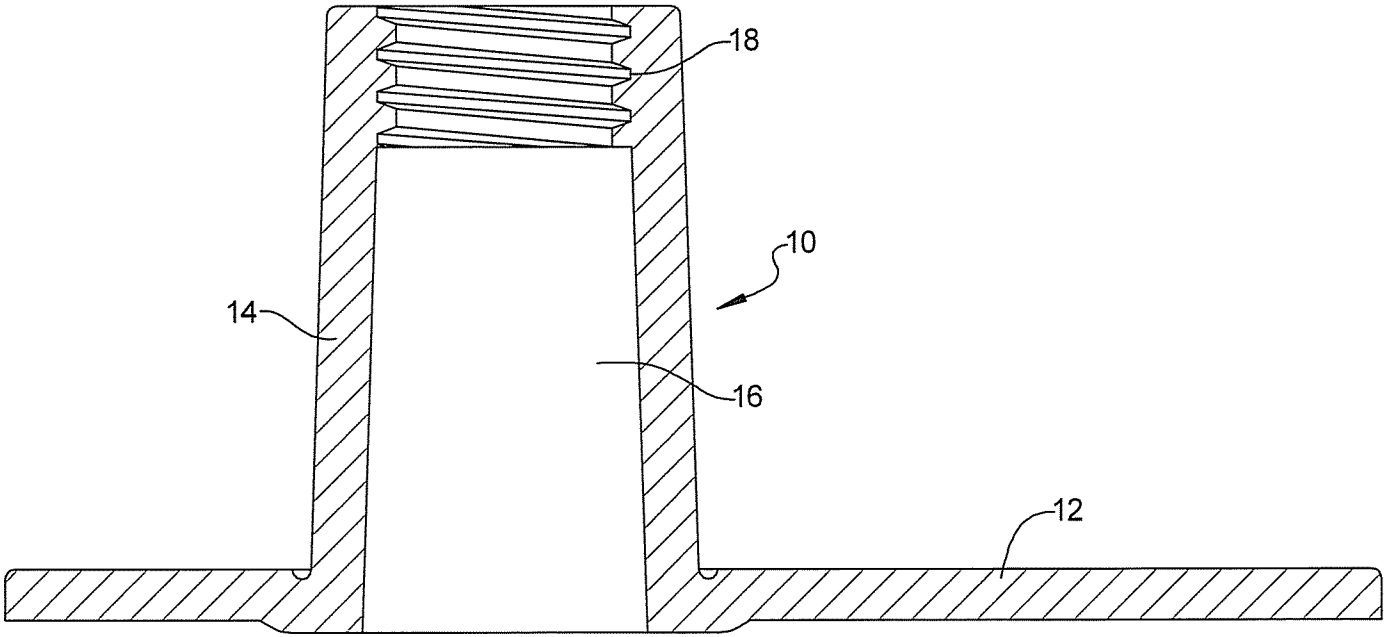
FIG. 1 is a cross sectional front elevational view of a first embodiment anchor device taken at section 1 of FIG. 4.

Referring to FIG. 1, an anchor device 10 includes a flange portion 12 extending radially outward from a centrally located protruding raised column projection 14. The raised column projection 14 includes a hollow cavity 16 through which an anchor bolt (shown in FIG. 2) is assembled and set to a user defined position relative to the anchor device 10. A plurality of threads 18 are created interior to an open end of the cavity 16.

Figure 2:
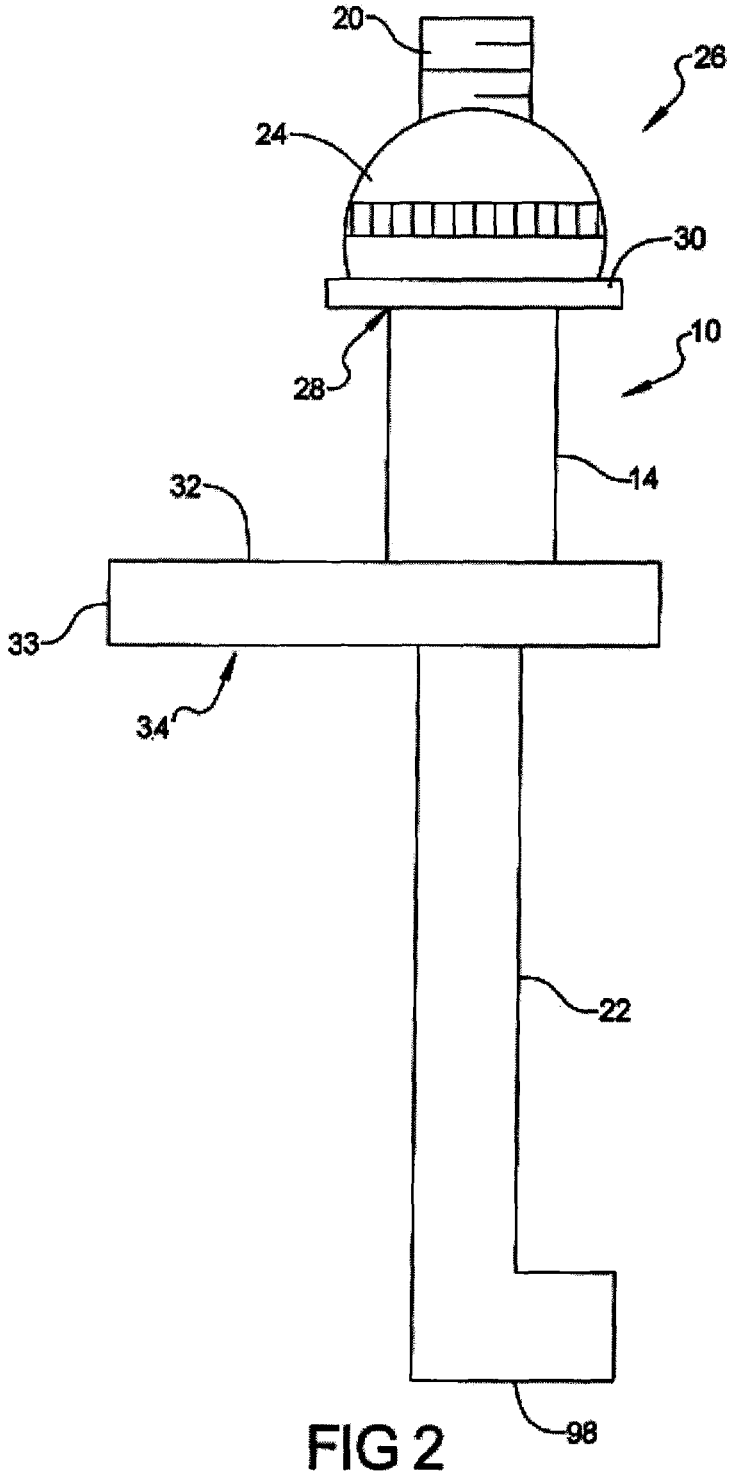
FIG. 2 is a front elevational view of an anchor bolt device having an anchor bolt, washer and anchor bolt nut together with the anchor device of FIG. 1.

Referring to FIG. 2, a short portion 20 of the anchor bolt 22 which has threads are set to protrude through the anchor device 10 to allow assembly of a typical anchor bolt nut 24. The anchor device 10 and anchor bolt 22 are further provided as an anchor bolt device 26 with the anchor bolt nut 24 tightened against an end 28 of the anchor device column projection 14, securely preventing further relative movement of the anchor device 10 or the anchor bolt 22. It is normal for a typical anchor bolt washer 30 to be included in the device 26 sandwiched between the anchor bolt nut 24 and the end 28 of the anchor device 10. The washer 30 is not required to secure the assembly of the anchor device 10 and the anchor bolt 22; however the washer 30 can be conveniently kept in place between the nut 24 and the anchor device 10 throughout shipping, storage, installation, and final attachment of a wall structure without requiring separate handling or logistics of a separate washer component. Another aspect of the subject anchor device 10 includes a flange portion 32 extending radially outward from the centrally located protruding raised column projection 14. The flange portion 32 may include one or more offset tabs 34.

Referring to FIG. 3 and again to FIGS. 1-2, the flange portion 32 can be used to position the anchor device 10 a defined offset distance "A" away from any one of several boundaries 33, 36 of the concrete defined by opposed first or second forms 38, 40 and/or offset from other objects set in a slurry 42. The flange portion 32 includes one relatively long offset tab 34 used to position the anchor device 10 at the defined offset distance "A".

Figure 3:
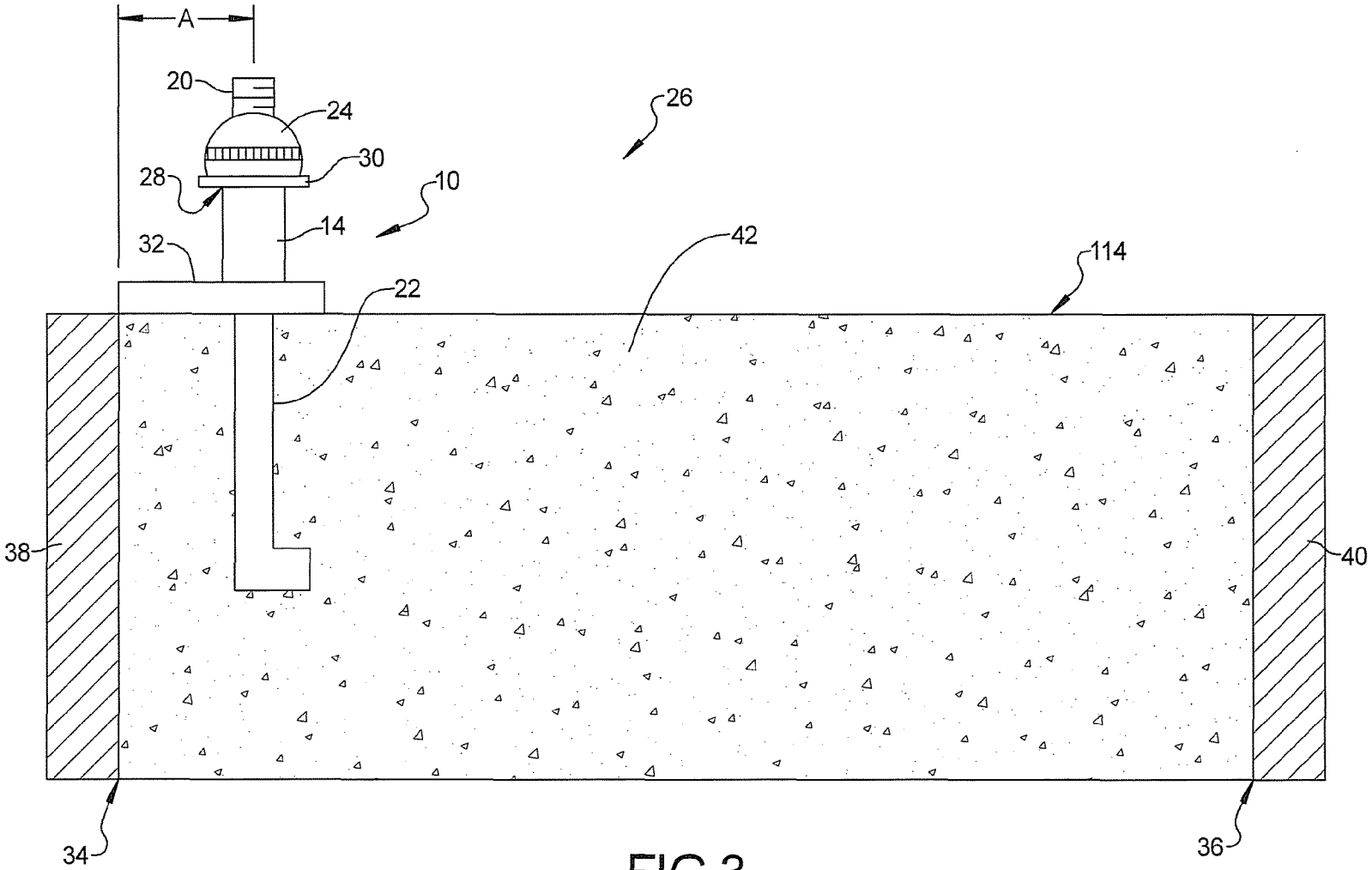
FIG. 3 is a partial cross sectional front elevational view of the device of FIG. 2 shown in a concrete slurry between forms.
Figure 4:
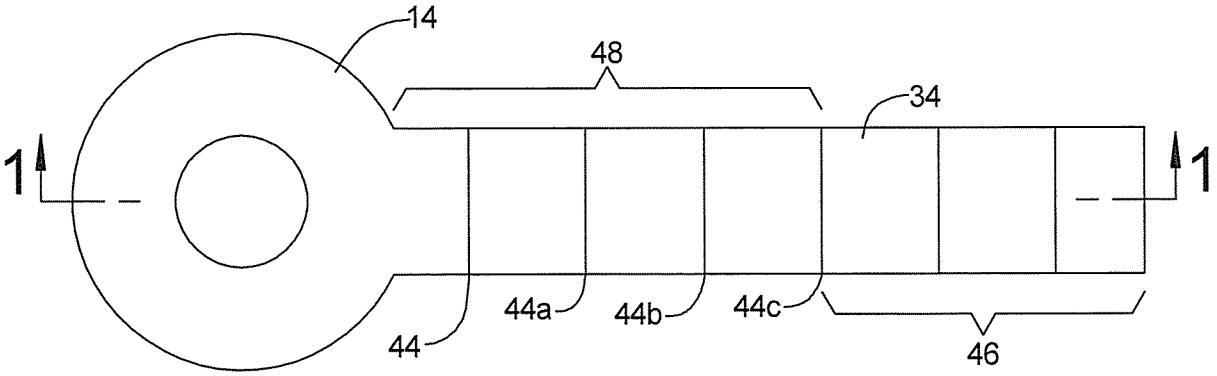
FIG. 4 is a top plan view of an anchor device of one embodiment.

Referring to FIG. 4 and again to FIG. 3, the long offset tab 34 includes a series of marks and/or easy break points 44 (such as break points 44*a*, 44*b*, 44*c*) which allow the user to establish the user defined offset distance "A" for the anchor device 10 by removing a portion 46 of the offset tab 34 to establish an appropriately shorter offset tab 48.

Figure 5:
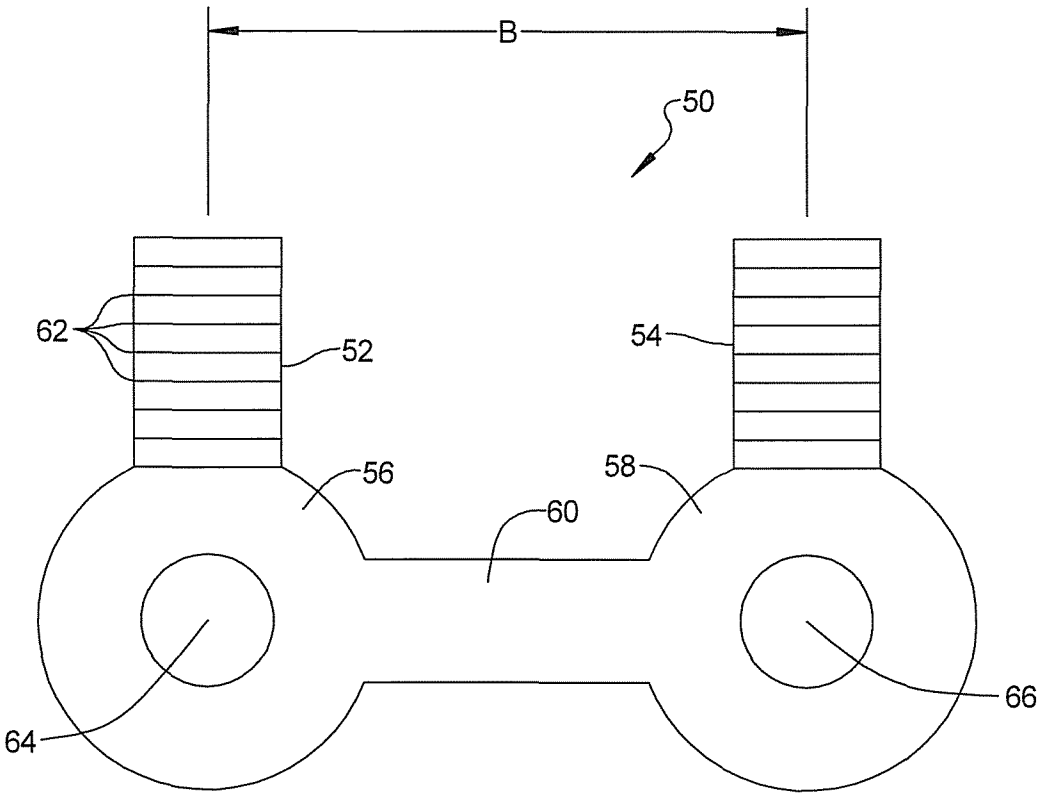
FIG. 5 is a top plan view of a second embodiment for an anchor device.

Referring to FIG. 5, and again to FIGS. 1-4, according to another aspect an anchor device 50 includes two flange portions, including a first flange portion 52 and a second flange portion 54 individually extending radially outward from a centrally located protruding raised column projection 56, 58. Each flange portion 52, 54 is juxtaposed to the other a set distance "B" with a connecting bridge portion 60 extending between them. The connecting bridge portion 60 is designed to provide appropriate resistance to deflection and/or bending forces during insertion in the concrete slurry (such as slurry 42 shown in FIG. 3). Each of the flange portions 52, 54 may include one or more offset tabs 62 used to position the anchor device 50 at the defined distance (such as defined distance "A" in reference to FIG. 3) away from the boundaries 33, 36 of the concrete and/or offset from other objects set in the slurry 42. Each raised column projection 56, 58 includes a hollow cavity 64, 66 through which a typical anchor bolt 22 (shown in FIG. 3) is assembled and set to a user defined position relative to the anchor device 50. Similar to the device in FIG. 3, the short portion 20 of each anchor bolt 22 threads are set to protrude through the raised column projections 56, 58 of anchor device 50 to allow assembly of typical anchor bolt nuts 24. The anchor device 50 and anchor bolts 22 are further assembled with typical anchor bolt nuts 24 tightened against the end (similar to end 28) of the raised column projections 56, 58 of anchor device 50 to securely prevent further relative movement of the anchor device 50 or the anchor bolts 22. Similar to anchor device 10, it is normal for a typical anchor bolt washer to be included in the device sandwiched between the nuts 24 and the ends of the raised column projections 56, 58 of anchor device 50. The washers are not required to secure the anchor device with the anchor bolts; however the washers can be conveniently kept in place between the nuts and the anchor device 50 throughout shipping, storage, installation, and final attachment of a wall structure without requiring separate handling or logistics of a separate washer component.

Figure 6:
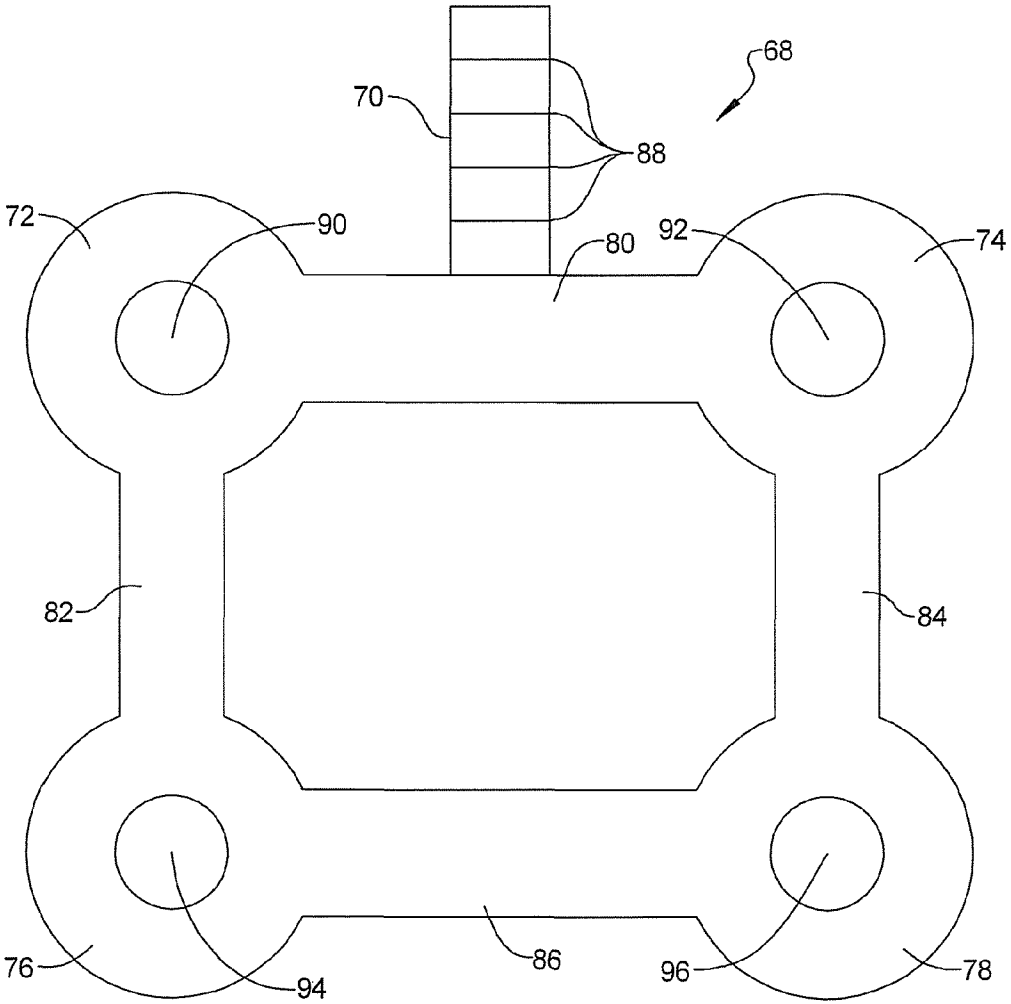
FIG. 6 is a top plan view of a third embodiment for an anchor device.

Referring to FIG. 6, and again to FIGS. 1-5, according to another aspect an anchor device 68 includes at least one flange portion 70 extending radially outward from four centrally located protruding raised column projections 72, 74, 76, 78. Each flange portion 70 is juxtaposed to the other a set distance with a relatively square pattern connecting bridge portion 80 extending between raised column projections 72, 74; a connecting bridge portion 82 extending between raised column projections 72, 76; a connecting bridge portion 84 extending between raised column projections 74, 78, and a connecting bridge portion 86 extending between raised column projections 76, 78. The connecting bridge portions 80, 82, 84, 86 are designed to provide appropriate resistance to deflection and/or bending forces during insertion in the concrete slurry. The flange portions 70 may include one or more offset tabs 88 used to position the device a defined distance away from one of the boundaries of the concrete and/or offset from other objects set in the slurry. Each raised column projection 72, 74, 76, 78 includes a hollow cavity 90, 92, 94, 96 through which a typical anchor bolt 22 is assembled and set to a user defined position relative to the anchor device 68. Similar to anchor devices 10, 50 a short portion of each anchor bolt threads are set to protrude through the raised column projections 72, 74, 76, 78 of anchor device 68 to allow assembly of a typical anchor bolt nut for each. The anchor device 68 and anchor bolts 22 are further assembled with typical anchor bolt nuts 24 tightened against the ends of the raised column projections 72, 74, 76, 78 of anchor device 68 securely preventing further relative movement of the anchor device 68 or the anchor bolts 22. It is normal for a typical anchor bolt washer to be included in the device sandwiched between the nut and the end of the device. The washer is not required to secure the device with its anchor bolts; however the washers can be conveniently kept in place between the nut and the device throughout shipping, storage, installation, and final attachment of a wall structure without requiring separate handling or logistics of a separate washer component.

Each of the aspects of the first embodiment provide a means for the user to establish a defined position of the anchor bolt 22 relative to the anchor device by assembling the anchor bolt 22 with more or less threads protruding through the end of the anchor device, thus allowing the user to set the anchor bolt 22 at a defined depth in the concrete slurry 42. Each of the embodiments also provides a means for the user to establish a defined position for the orientation of the bent tail 98, 98', 98" (see FIGS. 2 and 7) of the anchor bolt 22 relative to the offset tab 34 of the device by rotating the bent tail 98, 98', 98" to desired position relative to the offset tab 34 prior to tightening the anchor bolt nut 24 against the end of the raised column projection(s) of the anchor device, thus allowing the user to set the anchor bolt bent tail 98, 98', 98" to a specific orientation in the concrete slurry 42.

Referring to FIGS. 7-9 and again to FIGS. 1-8, each of the aspects of the first embodiment further provides the user with an improved method of use to establish an orientation and position of the anchor bolt device 10, 50, 68 in the concrete slurry 42 by taking advantage of a 3-axis gimbal feature defined by a first axis of relative vertical rotation (yaw) 100 and a second axis of relative lateral rotation (pitch) 102 and a third axis of relative longitudinal rotation (roll) 104. The improved method makes use of the first gimbal axis 100 by allowing the user to rotate the entire device 26 about the general centerline 106 of the anchor bolt 22; the rotation represents relative vertical rotation (yaw) in a gimbal system. The improved method makes use of the second gimbal axis 102 by allowing the user to rotate the entire device 26 generally parallel to the boundary form 33, 36 of the concrete such that the flange portion 32 of the anchor device 10, 50, 68 is generally following the path of an arc 108 which is generally following the circumferential part of a circle whose origin is near the end 110 of the anchor bolt 22 embedded in the slurry 42; the rotations represent relative lateral rotation (pitch) in a gimbal system. The improved method makes use of the third gimbal axis 104 by allowing the user to rotate the entire device 26 generally perpendicular to the boundary form 33, 36 of the concrete such that the flange portion 32 of the anchor device 10, 50, 68 is generally following the path of an arc 112 which is generally following the circumferential part of a circle whose origin is near the end 110 of the anchor bolt 22 embedded in the slurry 42; the rotations represent relative longitudinal rotation (roll) in a gimbal system.

Those skilled in the art will readily recognize and appreciate the user is able to employ the benefits of the 3-axis gimbal as an improved method of placement and positioning to establish and maintain a deliberate vertical or relatively plumb orientation of the anchor bolt 22 if desired. Visual monitoring and/or checking with a level will verify the device maintains the relatively plumb orientation during concrete surface finishing and currying. In addition the user is able to employ the 3-axis gimbal as an improved method to establish and/or maintain a deliberately off-plumb angled orientation of the anchor bolt 22 relative to surface 114 (see FIG. 3) of the concrete slurry 42. Checking with a protractor or angled fixture will ensure the device maintains the desired off-plumb orientation relative to the surface of the concrete slurry 42.

Embodiment 2

The second embodiment of the subject invention relates to a device and a method for using the device to orient and position a skewed anchor bolt in cured concrete or in a concrete slurry.

Figure 10:
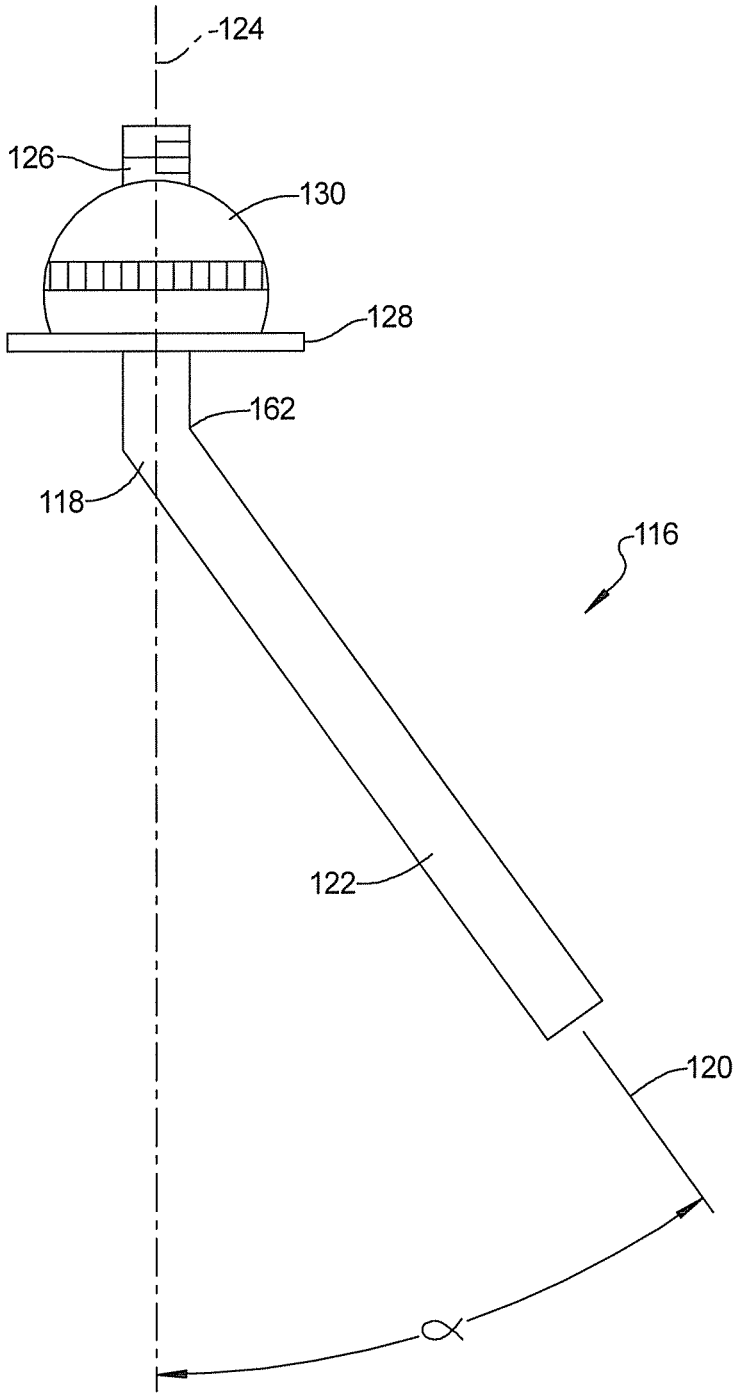
FIG. 10 is a front elevational view of a skewed anchor bolt device of another embodiment.

Referring to FIG. 10, a first aspect of the subject device includes an anchor bolt device 116 having an anchor bolt 118. Anchor bolt 118 includes an axis 120 of a skewed tail portion 122 that is angled defining an angle $\alpha$ ranging approximately between 15 to 45 degrees relative to an axis 124 of a threaded portion 126. Anchor bolt device 116 can further include an anchor bolt washer 128 slidably inserted onto threaded portion 126, and an anchor nut 130 threaded onto threaded portion 126.

Referring to FIG. 11 and again to FIG. 10, another component or piece of the anchor bolt device 116 is a cover plate 132 with a receiving hole 134 for the threaded portion 126 of the anchor bolt 118 to pass through. The cover plate 132 includes a method of being fastened to a wall plate construction 136. One preferred securing method includes fastening screws 138*a*, 138*b* passing through the cover plate 132 and into the wall plate construction 136 during construction. Other fastening methods include nail type fasteners, lag bolts, studs in the wall plate construction 136, etc. (not shown).

A relatively or substantially vertical first hole 140 is drilled or formed in the wall plate construction 136 (including the cover plate 132 and a concrete slab 146) and a second hole 142 skewed to approximately match the angled tail portion 122 of the anchor bolt 118 is joined to the first hole 140 forming a slot like receiving hole 144. The skewed anchor bolt tail portion 122 is inserted into the skewed hole 142 and covered with the cover plate 132. Once the cover plate 132 is secured in place the anchor bolt nut 130 can be secured and tightened. Once tightened, the wall plate construction 136 will be firmly anchored to the concrete 146.

The skewed tail portion 122 of the anchor bolt 118 prevents rotation of the anchor bolt 118 during tightening of the nut 130. The cover plate 132 prevents the skewed anchor bolt 118 from lifting upward during tightening of the nut 130. The cover plate 132 also serves a dual purpose of providing the service of a typical washer and in most cases eliminates the need for a separate washer such as anchor bolt washer 128. The cover plate 132 also spreads the restraining forces of the anchor bolt 118 over a larger expanded area than a typical washer, thereby providing a more stable mounting of the wall plate construction 136 to the concrete 146. The threaded portion 126 of the anchor bolt 118 can have taps or other fastening ends attached to the anchor bolt 118 to facilitate various construction applications.

Figure 11:
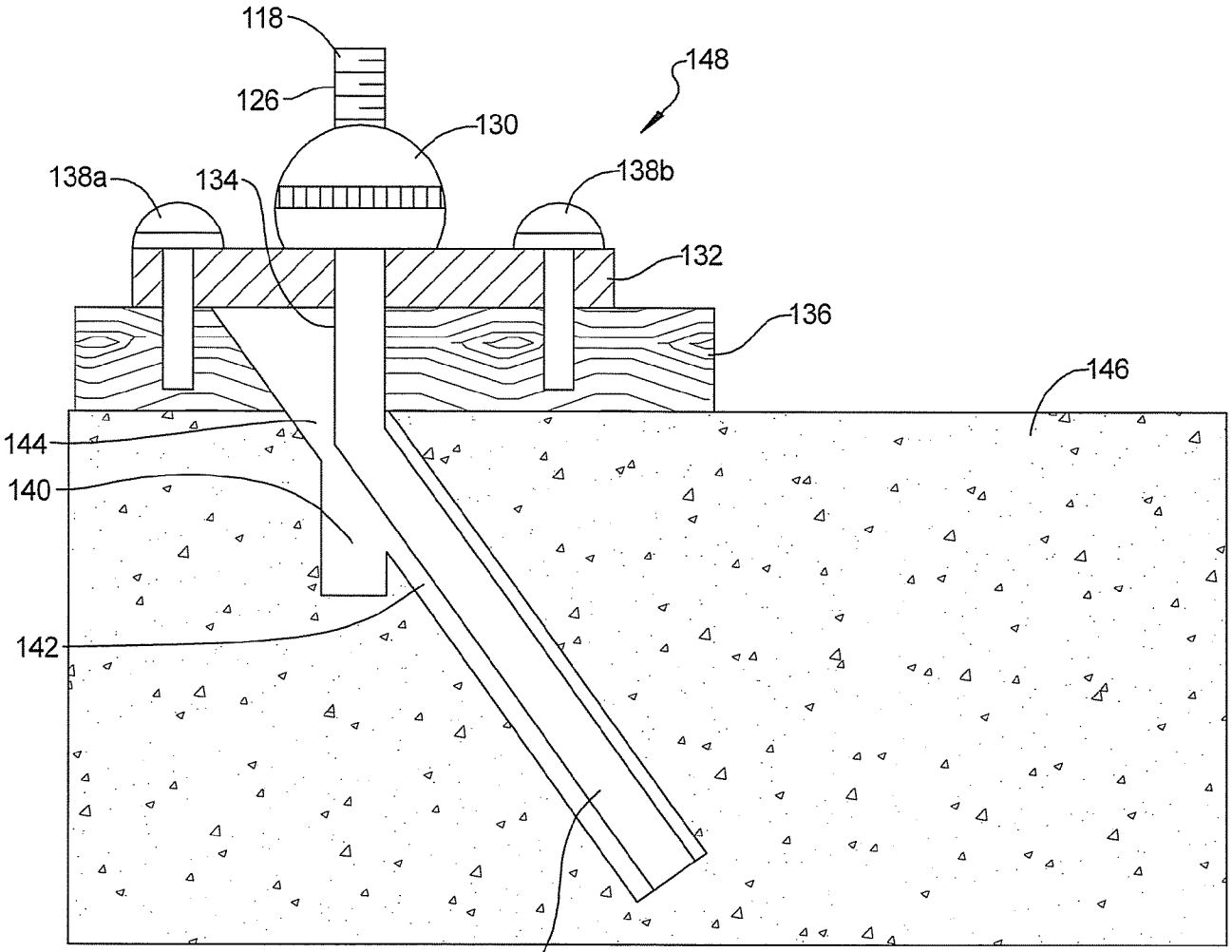
FIG. 11 is a partial cross sectional front elevational view of an installed position of the skewed anchor bolt device of FIG. 10.

Referring to FIG. 12 and again to FIGS. 10-11, an alternative variation of this embodiment provides the skewed anchor bolt 118 fastened to the cover plate 132 as an anchor bolt device 148. The device 148 provides less loose parts. The device 148 also allows for a threaded tap 150 in the cover plate 132 or other fastening methods to facilitate various fastening applications.

Figure 12:
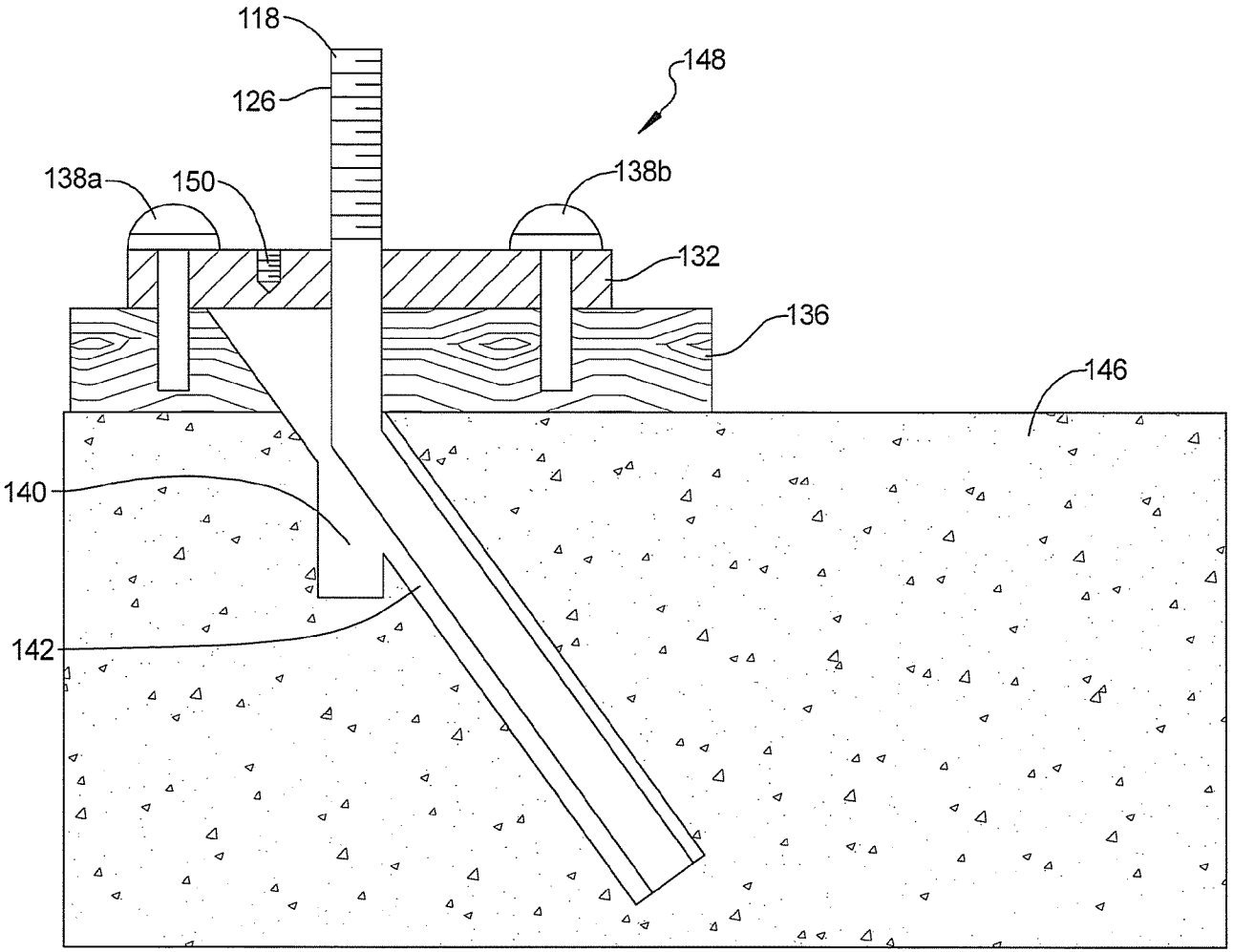
FIG. 12 is a partial cross sectional front elevational view of an installed position of a second skewed anchor bolt device.
Figure 13:
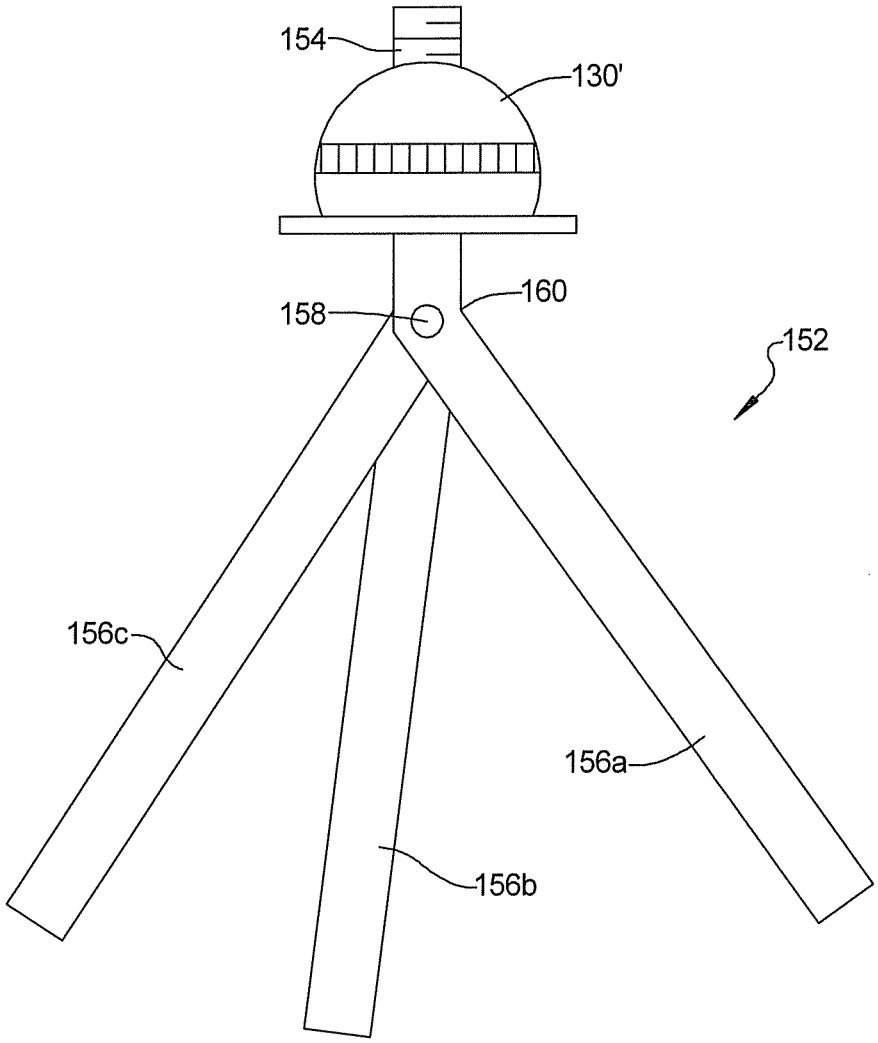
FIG. 13 is a front elevational view of an articulated anchor bolt device embodiment.

Referring to FIG. 13 and again to FIGS. 10-12, another alternative variation of the second embodiment is an articulated anchor bolt device 152 comprised of a first bolt portion 154 threaded to receive an anchor bolt nut 130'. The first bolt portion 152 is received through the cover plate 132 as has been described in this disclosure. A second bolt portion 156*a*, 156*b*, 156*c* of the articulated anchor bolt device 152 is attached to the first bolt portion 154 via a hinge or swivel like connection 158. The hinge 158 provides adjustable articulation of the articulated anchor bolt device 152. The adjustable articulation allows the articulated anchor bolt device 152 to match hole angle variations between vertical hole 140 and skewed hole 142 that may occur in the natural course of construction. The articulation can also be accomplished via any one of a number of typical standard manufacturing techniques, such as a weakened geometry 160 used in place of hinge 158 allowing the installer to "bend-to-suit", or with reference again to FIG. 10 an anchor bolt device comprised of a separate relatively flexible portion 162 installed between the two straight portions of threaded portion 126 and skewed tail 122.

Embodiment 3

The third embodiment relates to a device and a method for using the device to orient and position a flush anchor bolt embedded in a concrete slurry and then maintain that position until the slurry has hardened. The device and method further eliminates the need to protect the threaded portion of a typical exposed anchor bolt until such time that a wall construction is attached to the anchor bolt, because the flush anchor bolt device of the subject invention has no protruding threads or portions above the surface of the slurry.

Referring to FIG. 14 and again to FIGS. 2 and 3, in one aspect an anchor bolt device 164 for submergence in concrete includes a flange portion 166 extending radially outward from a centrally located submerged column projection 168. The flange portion 166 may include one or more offset tabs 170, which, similar to offset tab 34 of anchor device 10, are used to position the anchor bolt device 164 a defined distance "C" away from boundaries 172 or 174 of the concrete/slurry and/or offset from other objects set in the slurry 176.

Figure 14:
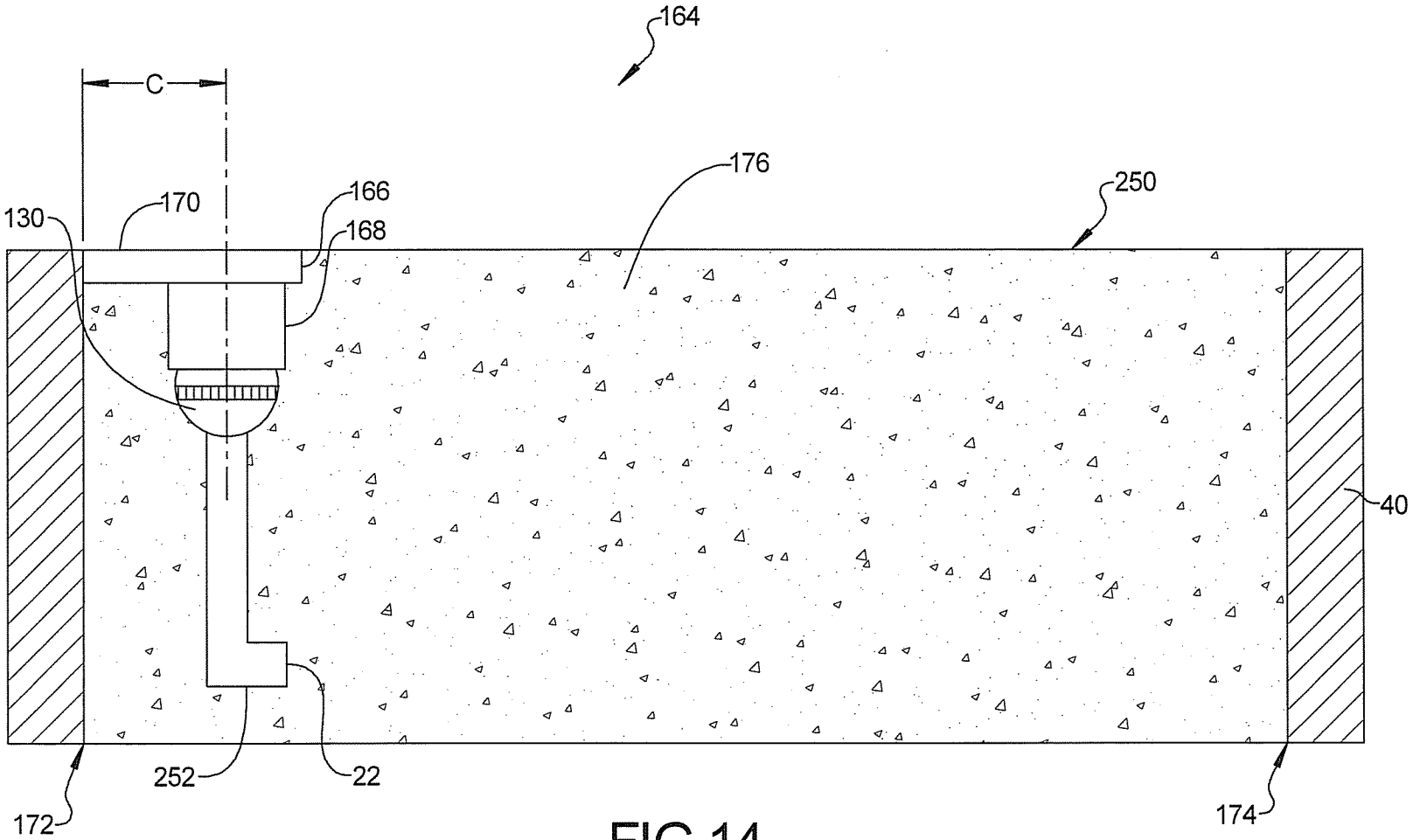
FIG. 14 is a partial cross sectional front elevational view similar to FIGS. 3 and 16, of an installed position of a submerged anchor device embodiment.
Figure 15:
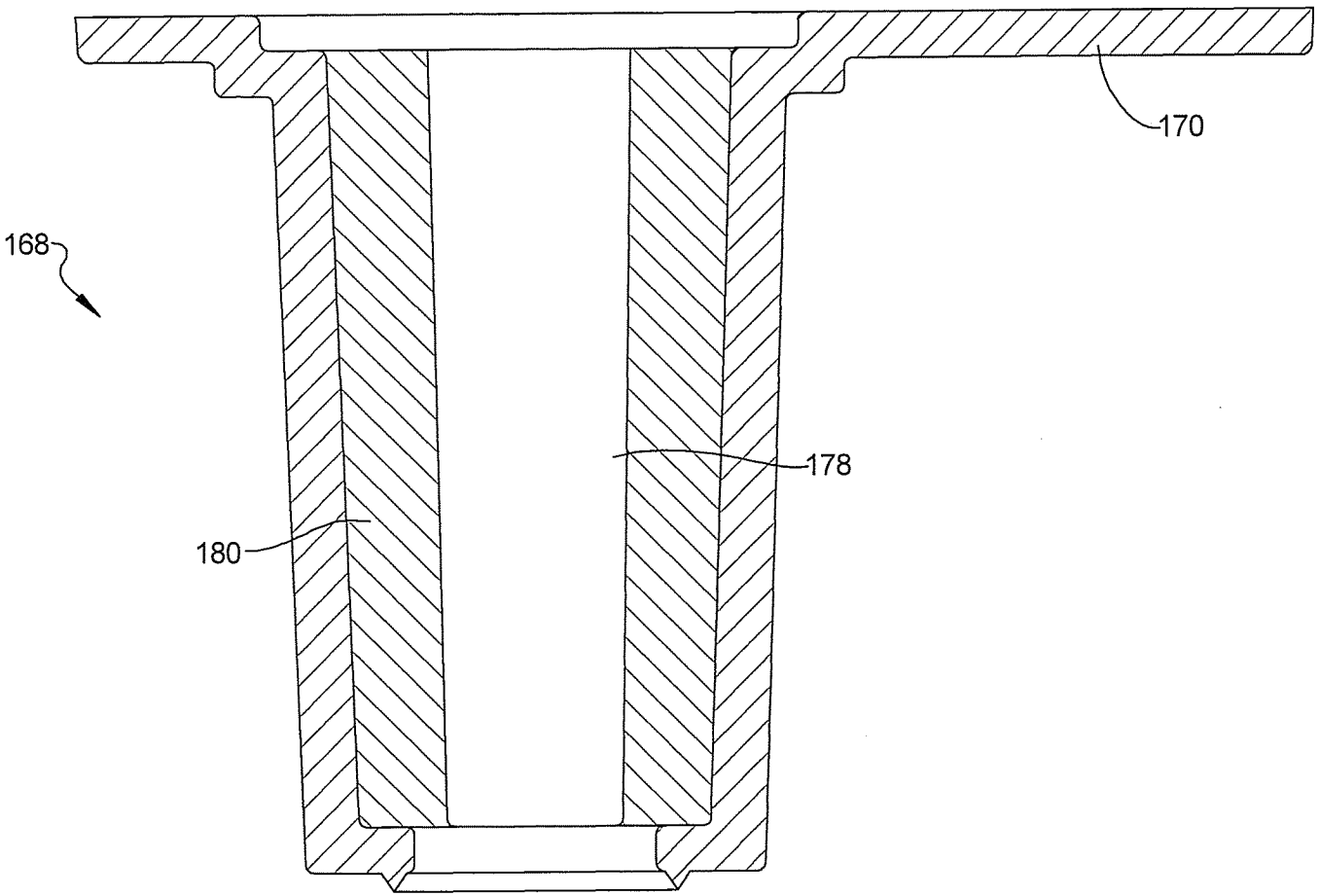
FIG. 15 is a cross sectional front elevational view taken at section 15 of FIG. 17.
Figure 16:
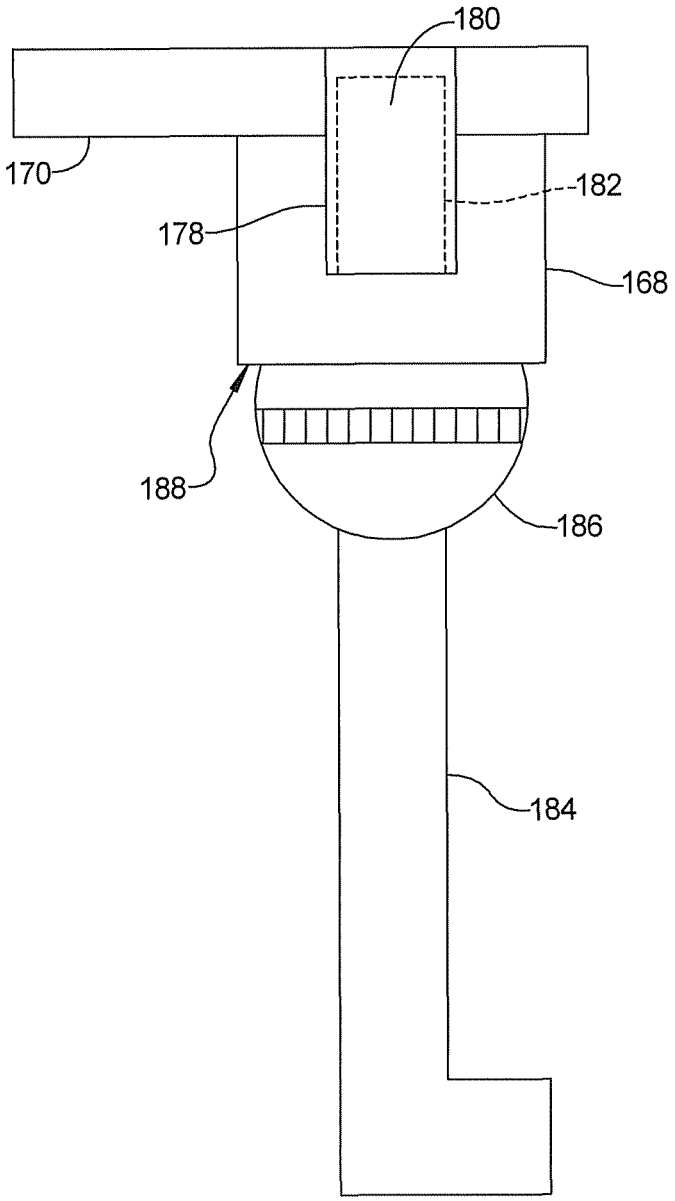
FIG. 16 is a front elevational view of an anchor bolt device including the anchor device of FIG. 14.

Referring to FIGS. 15 and 16 and again to FIG. 14, the submerged column projection 168 includes a hollow cavity 178 into which a typical coupling nut 180 is assembled and threaded onto an end 182 of a typical anchor bolt 184. The coupling nut 180 and a typical anchor bolt nut 186 are further assembled with anchor bolt 184 and tightened, sandwiching one end 188 of the submerged column projection 168, thereby securely preventing further relative movement of the device components.

Figure 17:
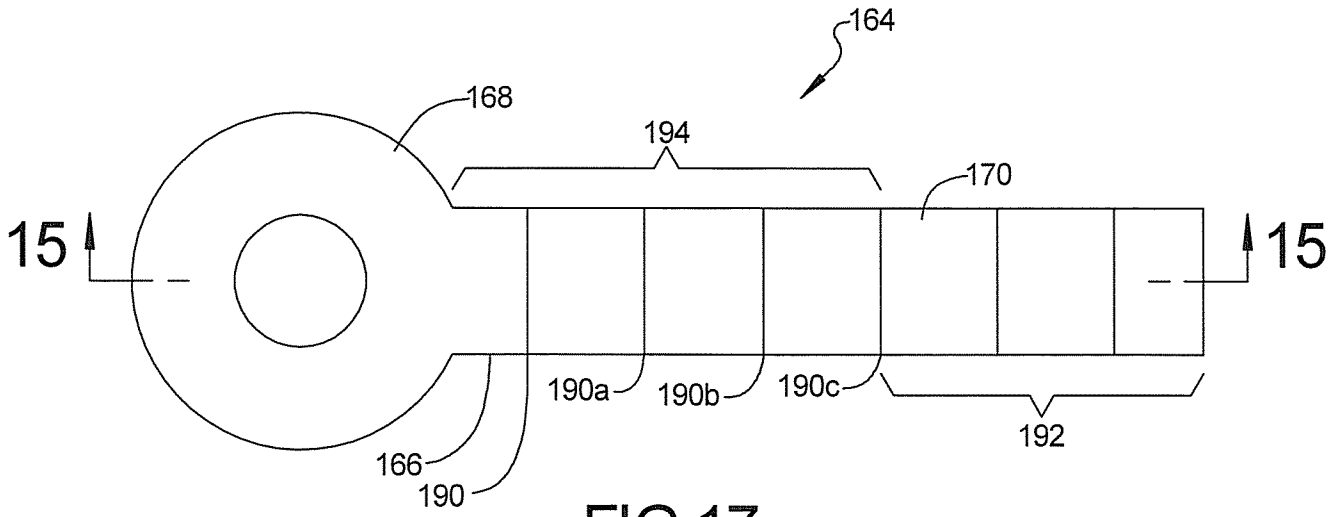
FIG. 17 is a top plan view of another anchor device embodiment.

Referring to FIG. 17 and again to FIGS. 14-16 and FIG. 4, a further aspect of the subject anchor bolt device 164, the flange portion 166 extending radially outward from the centrally located protruding submerged column projection 168 includes the relatively long offset tab 170 used to position the anchor bolt device 164 at the defined offset distance "C" away from the boundaries 172 or 174 of the concrete and/or offset from other objects set in the slurry 176. The long offset tab 170 includes a series of marks and/or easy break points 190 such as break points 190*a*, 190*b*, 190*c* which allow the user to establish the user defined offset distance "C" for the anchor bolt device 164 by removing a portion 192 of the offset tab 170 to establish an appropriately shorter offset tab 194.

Referring to FIG. 18 and again to FIGS. 14-17 and FIG. 5, in yet another aspect an anchor device 196 includes two flange portions 198, 200 individually extending radially outward from two centrally located protruding submerged column projections 202, 204. Each flange portion 198, 200 is juxtaposed to the other a set distance "D" with a connecting bridge portion 206 extending between them. The connecting bridge portion 206 is designed to provide appropriate resistance to deflection and/or bending forces during insertion in the concrete slurry 176. The flange portions 198, 200 may include one or more offset tabs 208, 210 used to position the anchor device 196 at the defined distance "C" away from boundaries 172, 174 of the concrete and/or offset from other objects set in the slurry 176. When combined with two anchor bolts, anchor bolt nuts and anchor bolt washers, the anchor bolts nuts and washers plus anchor device 196 together define a two-bolt anchor bolt device.

Referring to FIG. 19 and again to FIGS. 14-18 and FIGS. 2 and 6, still another aspect of the includes four flange portions extending radially outward from a centrally located protruding submerged column projection. Each flange portion is juxtaposed to the other a set distance with a relatively square pattern connecting bridge portion extending between them. The connecting bridge portion is designed to provide appropriate resistance to deflection and/or bending forces during insertion in the concrete slurry. The flange portions may include one or more offset tabs used to position the device a defined distance away from boundaries of the concrete and/or offset from other objects set in the slurry.

An anchor device 212 is similar to anchor device 68 and includes four flange portions 214, 216, 218, 220 individually extending radially outward from four centrally located protruding raised column projections 222, 224, 226, 228. Each flange portion 214, 216, 218, 220 is juxtaposed to another a set distance with a relatively square pattern connecting bridge portion 230 extending between raised column projections 222, 224; a connecting bridge portion 232 extending between raised column projections 222, 226; a connecting bridge portion 234 extending between raised column projections 224, 228, and a connecting bridge portion 236 extending between raised column projections 226, 228. The connecting bridge portions 230, 232, 234, 236 are designed to provide appropriate resistance to deflection and/or bending forces during insertion in the concrete slurry 176. The flange portions 214, 216, 218, 220 may include one or more offset tabs 238 having break points 240 used to position the anchor device 212 at the defined distance "C" away from one of the boundaries 172, 174 of the concrete and/or offset from other objects set in the slurry 176.

Each raised column projection 222, 224, 226, 228 includes a hollow cavity 242, 244, 246, 248 through which a typical anchor bolt 22 is assembled and set to a user defined position relative to the anchor device 212. Similar to anchor devices 10, 50 a short portion of each anchor bolt threads are set to protrude through the raised column projections 222, 224, 226, 228 of anchor device 212 to allow assembly of a typical anchor bolt nut 24 for each. The anchor device 212 and anchor bolts 22 are further assembled with typical anchor bolt nuts 24 tightened against the ends of the raised column projections 222, 224, 226, 228 of anchor device 212 securely preventing further relative movement of the anchor device 212 or the anchor bolts 22. When combined with four anchor bolts, anchor bolt nuts and anchor bolt washers, the anchor bolts nuts and washers plus anchor device 212 together define a four-bolt anchor bolt device.

Each of the embodiments of anchor bolt device 164 and anchor devices 196, 212 provide a means for the user to establish a defined position of the flush anchor bolt relative to the surface 250 (shown in FIG. 14) of the slurry 176 by assembling the one or more anchor bolts 22 with more or less threads protruding into the end of the coupling nut 180, thus allowing the user to set the anchor bolts 22 at a defined depth in the concrete slurry 176.

Each of the aspects of the third embodiment also provides a means for the user to establish a defined position for the orientation of a bent tail 252 of the anchor bolt 22 relative to the offset tab 170*a*, 170*b*, 170*c*, by rotating the bent tail 252 to a desired position relative to the offset tab 170*a*, 170*b*, 170*c* prior to tightening the anchor bolt nut 24 jammed against the end 188 of the submerged column, thus allowing the user to set the anchor bolt bent tail 252 to a specific orientation in the concrete slurry 176.

Each of the aspects of the third embodiment provides for an anchor device with a flange portion and a submerged column projection which cooperates with a typical anchor bolt by receiving a typical coupling nut to be threaded on the end of the anchor bolt. The device is completed sandwiching the end of the submerged column projection 168, 202, 204, 222, 224, 226, 228 between the coupling nut and a typical anchor bolt nut to jam up snug against each other. The assemblies provide convenient shipping and storing of the flush anchor bolts. The assemblies remain intact as they are placed in the concrete slurry and further remain assembled as the concrete cures.

Figure 18:
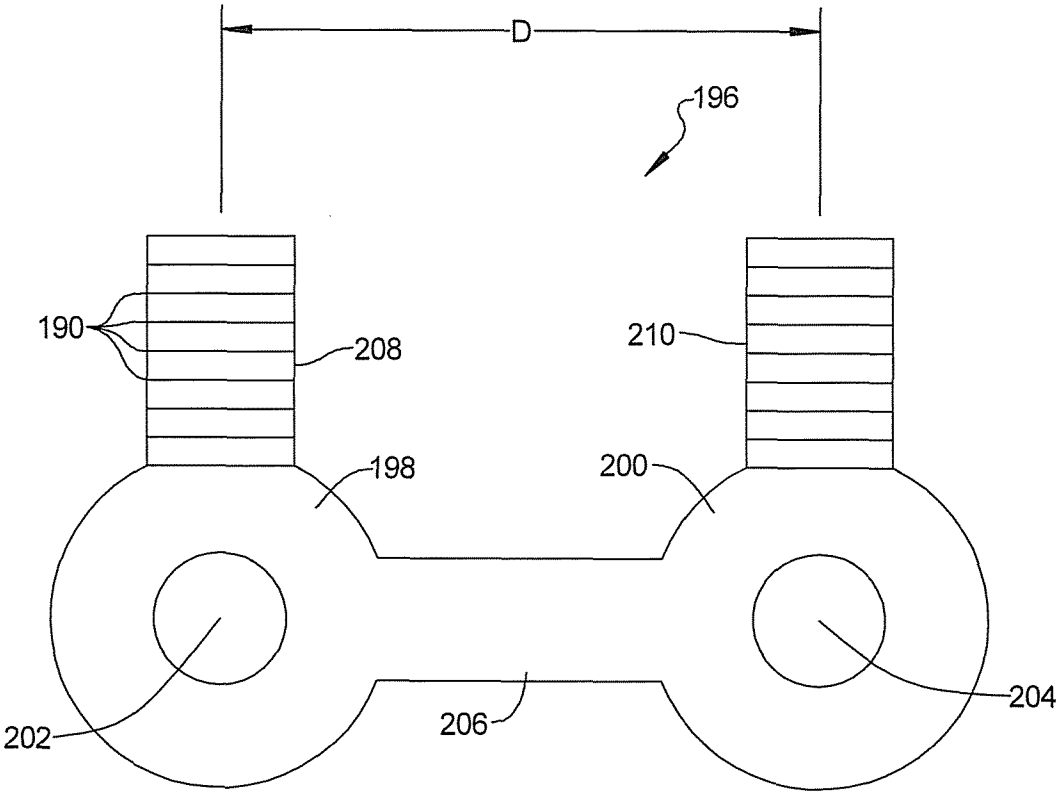
FIG. 18 is a top plan view of an anchor device modified from the anchor device of FIG. 17 to include a mirror image second anchor device and a connecting bridge.
Figure 19:
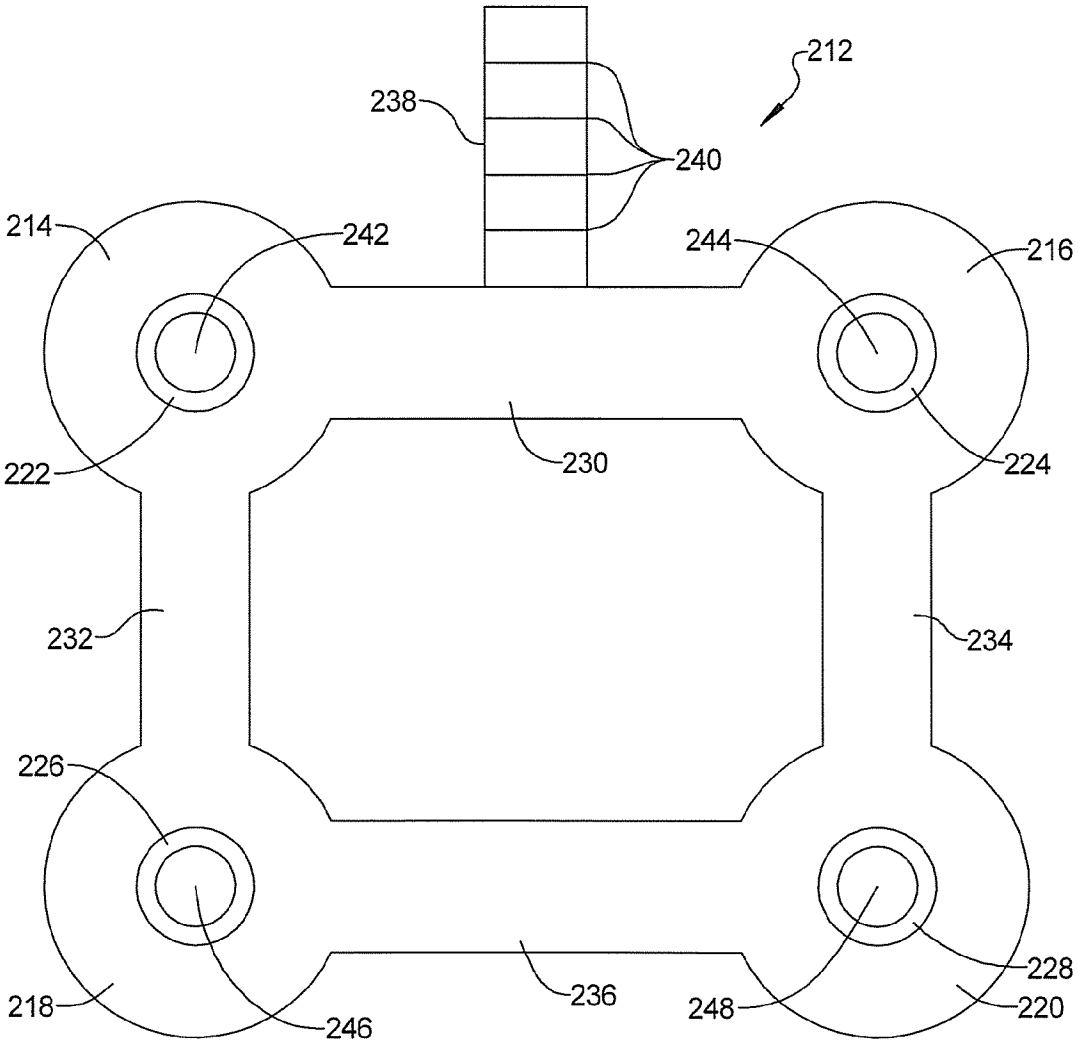
FIG. 19 is a top plan view of an anchor device modified from the anchor device of FIG. 18 to including first through fourth anchor devices joined by multiple connecting bridges.
Figure 20:
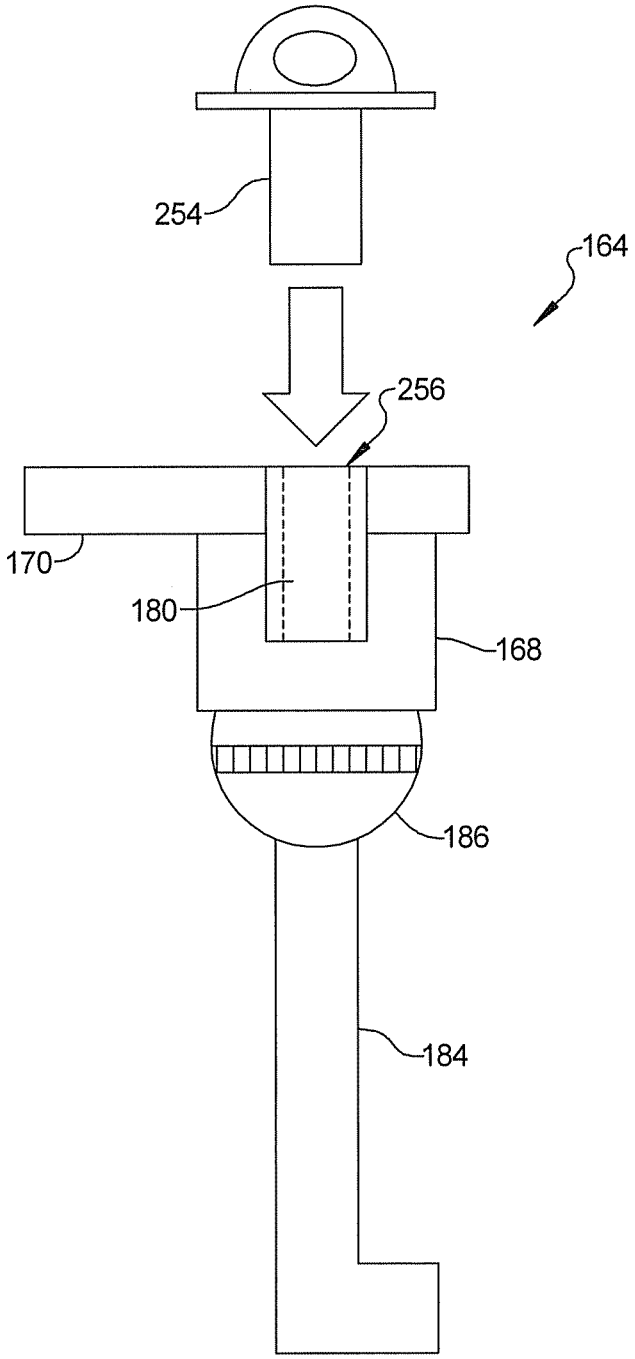
FIG. 20 is a front elevational view of an anchor bolt device of another embodiment.

Referring to FIG. 20 and again to FIGS. 14-19 and FIG. 11, for the exemplary embodiment of anchor bolt device 164, once the concrete slurry 176 cures and hardens a detachable plug 254 is removed leaving the anchor bolt device 164 with the anchor bolt 184 submerged and the offset tab 170 aligned flush or coplanar with surface of the concrete. A wall construction portion (see for example FIG. 11) is fitted with an appropriate through hole positioned for assembly over the flush anchor bolt 184 and an exposed end 256 of the coupling nut 180. A typical threaded bolt or other appropriate fastener (not shown) is extended through the hole in the wall construction and threaded into the coupling nut 180. Anchor bolt device 164, and anchor devices 196, 212 of the present disclosure provide for orienting and positioning a typical anchor bolt partially embedded in a concrete slurry with a flange portion able to be positioned flush with the surface of a concrete slurry.

Figure 7:
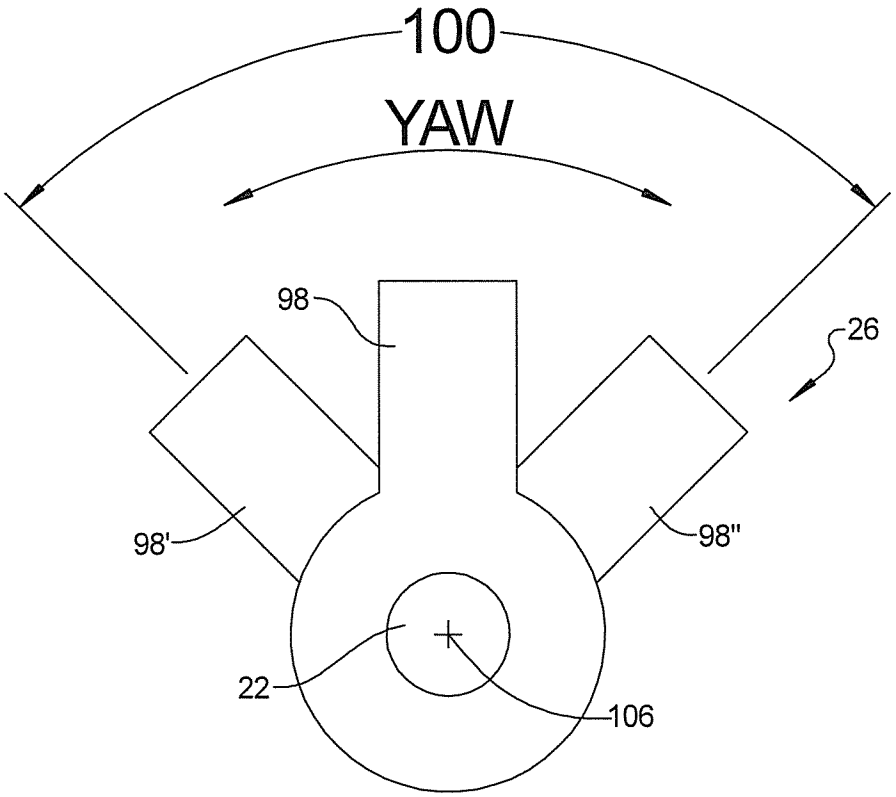
FIG. 7 is a top plan view of a yaw rotational direction for a gimbal installation method of the present disclosure.
Figure 8:
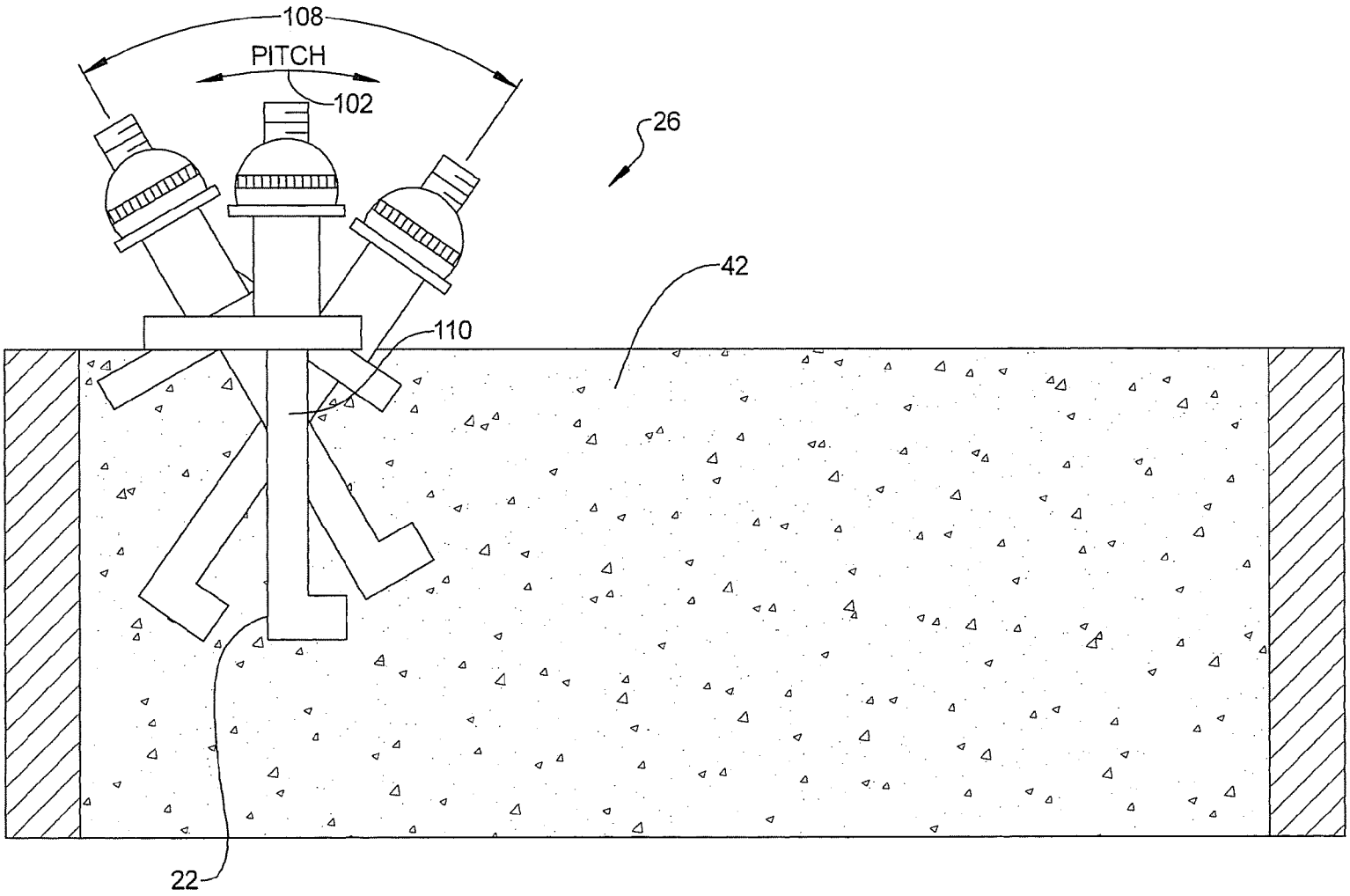
FIG. 8 is a partial cross sectional front elevational view similar to FIG. 3, of pitch rotational positions for the gimbal installation method.
Figure 9:
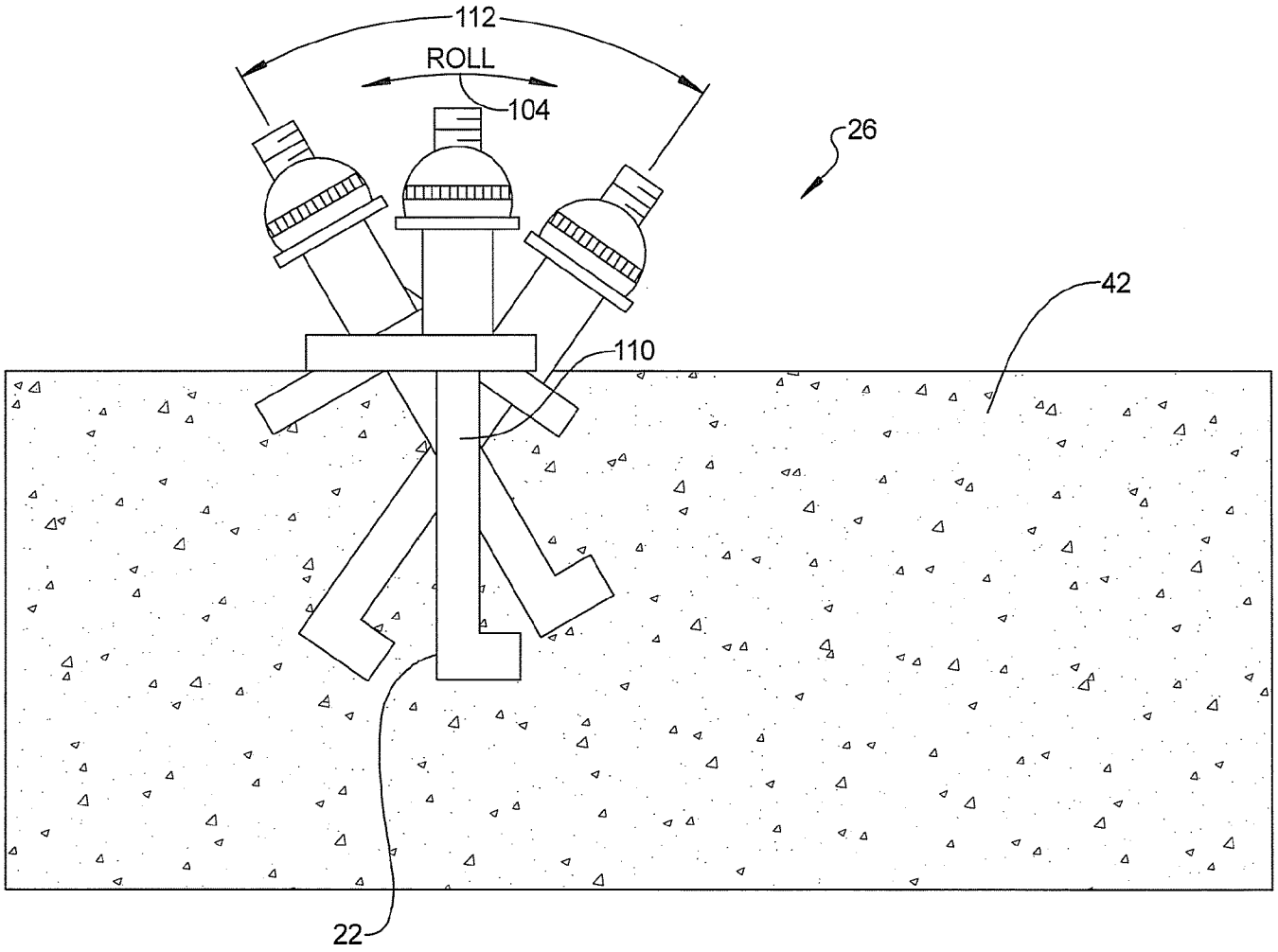
FIG. 9 is a front elevational view similar to FIG. 3, of a roll rotational positions for the gimbal installation method.
Figure 21:
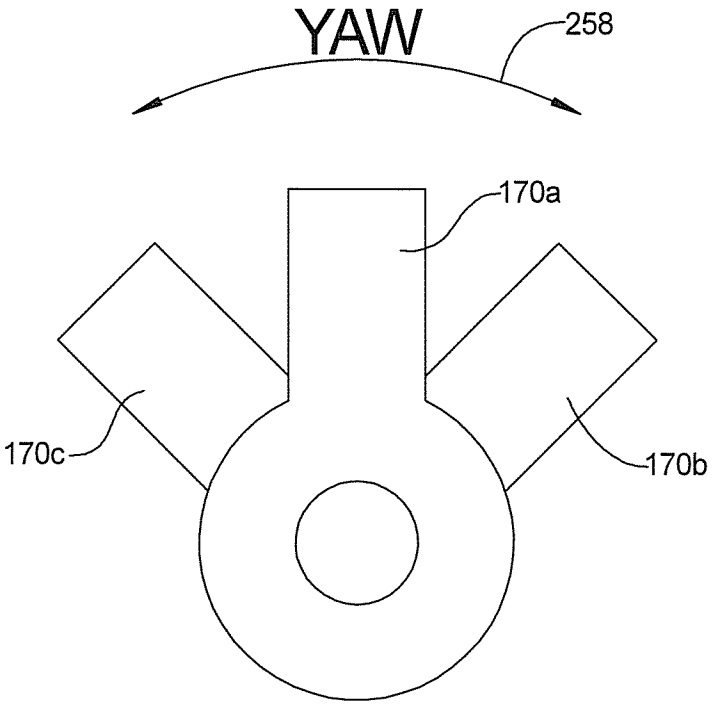
FIG. 21 is a top plan view of an anchor bolt device during yaw rotation.
Figure 22:
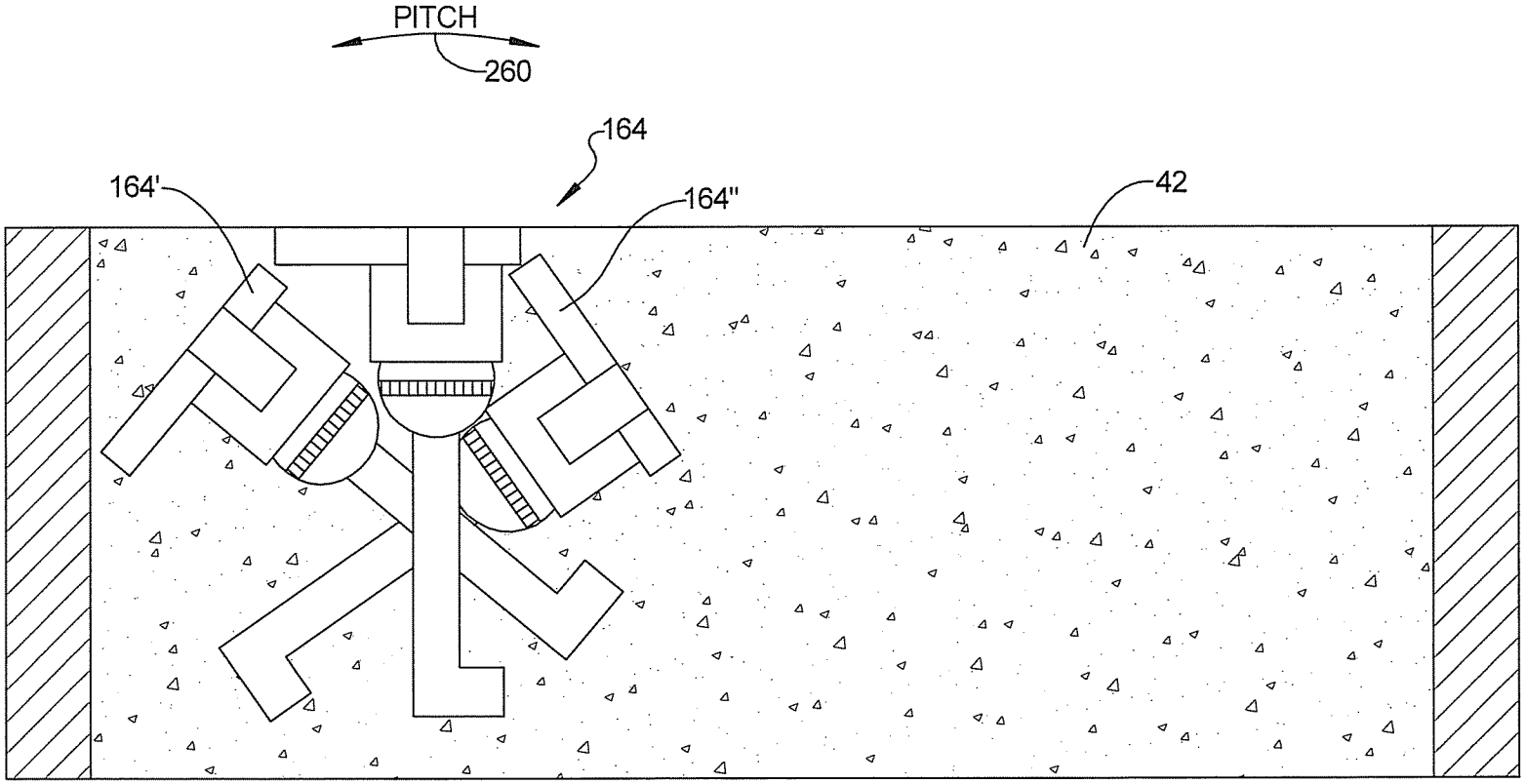
FIG. 22 is a top plan view of the anchor device of FIG. 21 during pitch rotation.
Figure 23:
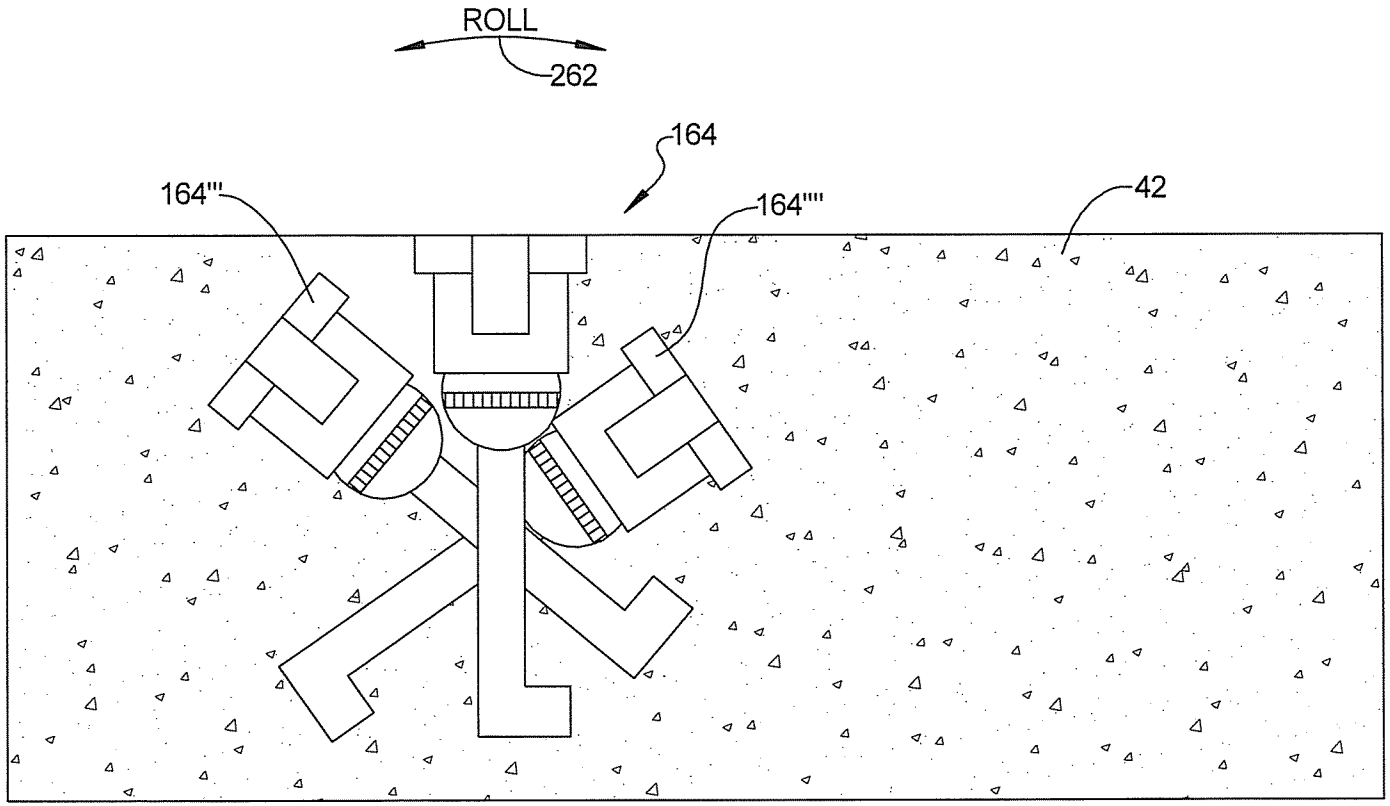
FIG. 23 is a top plan view of the anchor bolt device of FIG. 21 during roll rotation.

Referring to FIGS. 21-23 and again to FIGS. 14-20 and 7-9, each of the aspects of the third embodiment further provides the user with a method of use to establish an orientation and position of the anchor bolt device 164, 164', 164" and anchor devices 196, 212 (anchor bolt device 164, 164', 164" is shown in these examples) in concrete slurry by taking advantage of the 3-axis gimbal feature generally defined in reference to FIGS. 7-9 and by a first axis 258 of relative vertical rotation (yaw) and a second axis 260 of relative lateral rotation (pitch) and a third axis 262 of relative longitudinal rotation (roll). The improved method makes use of the first gimbal axis 258 by allowing the user to rotate the entire device about the general centerline of the anchor bolt; the rotation represents relative vertical rotation (yaw) in a gimbal system. The method makes use of the second gimbal axis 260 by allowing the user to rotate the entire device generally parallel to the boundary form of the concrete such that the flange portion of the device is generally following the path of an arc which is generally following the circumferential part of a circle whose origin is near the end of the anchor bolt embedded in the slurry; the rotations represents relative lateral rotation (pitch) in a gimbal system. The method makes use of the third gimbal axis 262 by allowing the user to rotate the entire device generally perpendicular to the boundary form of the concrete such that the flange portion of the device is generally following the path of an arc which is generally following the circumferential part of a circle whose origin is near the end of the anchor bolt embedded in the slurry; the rotations represents relative longitudinal rotation (roll) in a gimbal system.

Those skilled in the art will readily recognize and appreciate the user is able to employ the benefits of the 3-axis gimbal as an improved method of placement and positioning to establish and maintain a deliberate vertical or relatively plumb orientation of the flush anchor bolt if desired. Visual monitoring and/or checking with a level will verify the device maintains the relatively plumb orientation during concrete surface finishing and currying. In addition the user is able to employ the 3-axis gimbal as a method to establish and/or maintain a deliberately off-plumb angled orientation of the flush anchor bolt relative to the surface of the concrete slurry. Checking with a protractor or angled fixture will ensure the device maintains the desired off-plumb orientation relative to the surface of the concrete slurry.

Embodiment 4

According to several aspects of the fourth embodiment a device and a method for using the device to orient and position a bell bottom anchor bolt in a heavy slurry or in cured concrete is provided. The subject embodiment provides an anchor bolt similar to typical anchor bolts except that the traditional wedging or epoxy restraint methods are eliminated and replaced with an improved method of restraint in cured concrete or heavy slurry.

Figure 24:
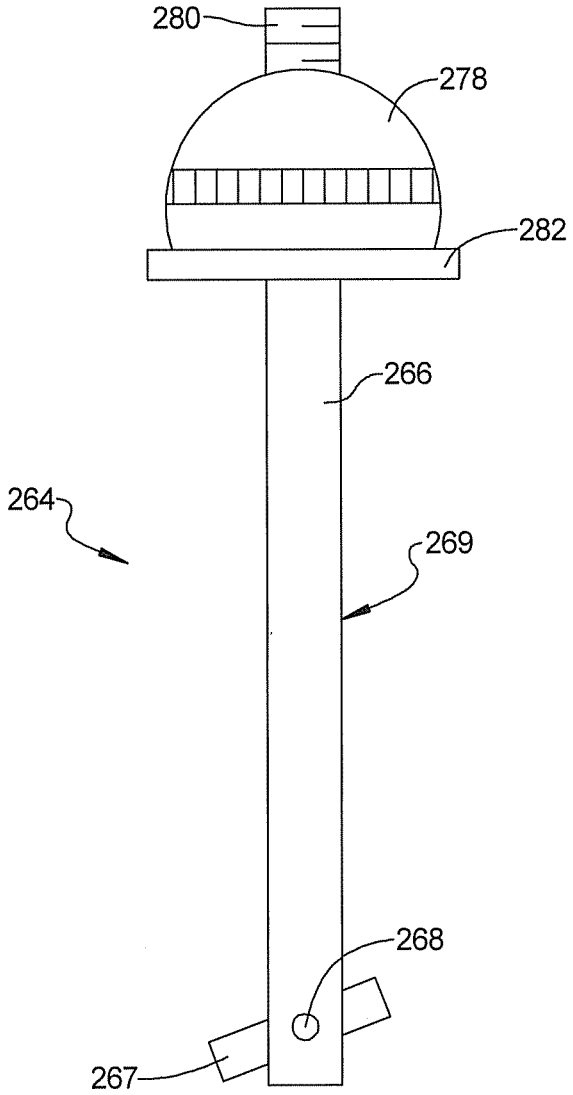
FIG. 24 is a front elevational view of another embodiment for an anchor bolt device having a rotatable toggle foot.

Referring to FIG. 24, according to one aspect an anchor bolt device 264 includes an anchor bolt 266 having a rotatable toggle like foot 267 or multiple feet rotatable with respect to a pin 268 at a free end of a bolt shank 269 which extend for example by rotating away from axial alignment with the bolt shank 269 during installation to a position angularly oriented with respect to the bolt shank 269 defining an anchor or retention position.

Referring to FIG. 25 and again to FIG. 24, the foot 267 of anchor bolt device 264 is shown after outward rotation away from an axis of bolt shank 269 to fill an expanded widened area "E" at the bottom of a bell bottom shaped hole 270. The method of use includes drilling a hole 272 relatively vertical through a typical wall plate construction 274 and into the cured concrete or slurry 276 to a desired depth to receive the bell bottom anchor bolt 266. The bottom of the hole 270 in the cured concrete or slurry 276 is then expanded to form the widened area "E". The bell bottom anchor bolt 266 is inserted into the hole 272 and seated at the bottom of the hole 270. The foot 267 of the bell bottom anchor bolt 266 is then expanded to approximately fill the widened area "E" at the bottom of the hole 270. A typical anchor bolt nut 278 is fastened to an exposed threaded portion 280 of the anchor bolt 266. The expanded portion or foot 267 of the bell bottom anchor bolt 266 provides anti-rotation extensions that serve a dual purpose of preventing extraction of the anchor bolt 266. The subject invention provides a bell bottom anchor bolt device 264 and method of assembly in cured concrete typical of residential or commercial structures. An anchor nut washer 282 can also be used at the anchor bolt nut 278.

Figure 25:
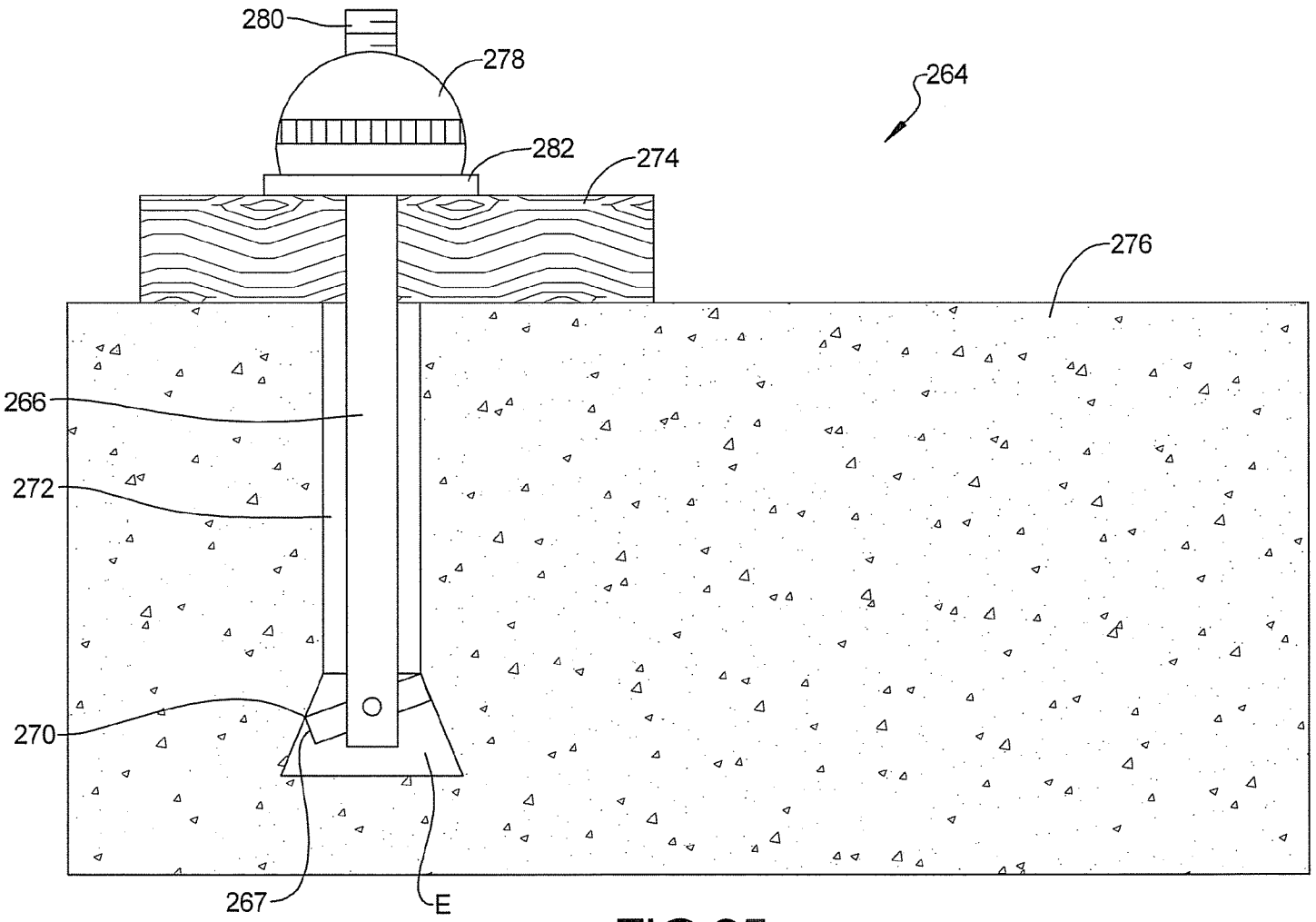
FIG. 25 is a partial cross sectional front elevational view of the anchor bolt device of FIG. 24 received in a bore created in a concrete foundation.

Referring to FIG. 26 and again to FIG. 25, according to another aspect a bell bottom anchor bolt device 284 includes an anchor bolt 286 with a wedge like expansion 288 to fill the expanded widened area "E" at the bottom of the hole 270. The bell bottom anchor bolt extensions 290 provide the dual purpose of preventing rotation of the anchor bolt 286 during tightening as well as prevention of extraction.

A unique or novel drill bit need not be used for expanding the widened area "E", although a drill bit is envisioned to facilitate the creation of a consistent bell bottom shape designed to closely approximate the shape of the bell bottom anchor bolt toggle foot 267 or wedge expansion 288. The threaded portion 280 of the anchor bolt 286 can have taps or other fastening ends attached to the anchor bolt to facilitate various construction applications. In addition, it will be appreciated that the application of this anchor bolt also includes providing hole 272 that extends all the through the concrete 276 such that the anchor bolt toggle foot 267 or bell bottom anchor bolt extensions 290 extend through to the underside of the concrete slab 276.

Figure 26:
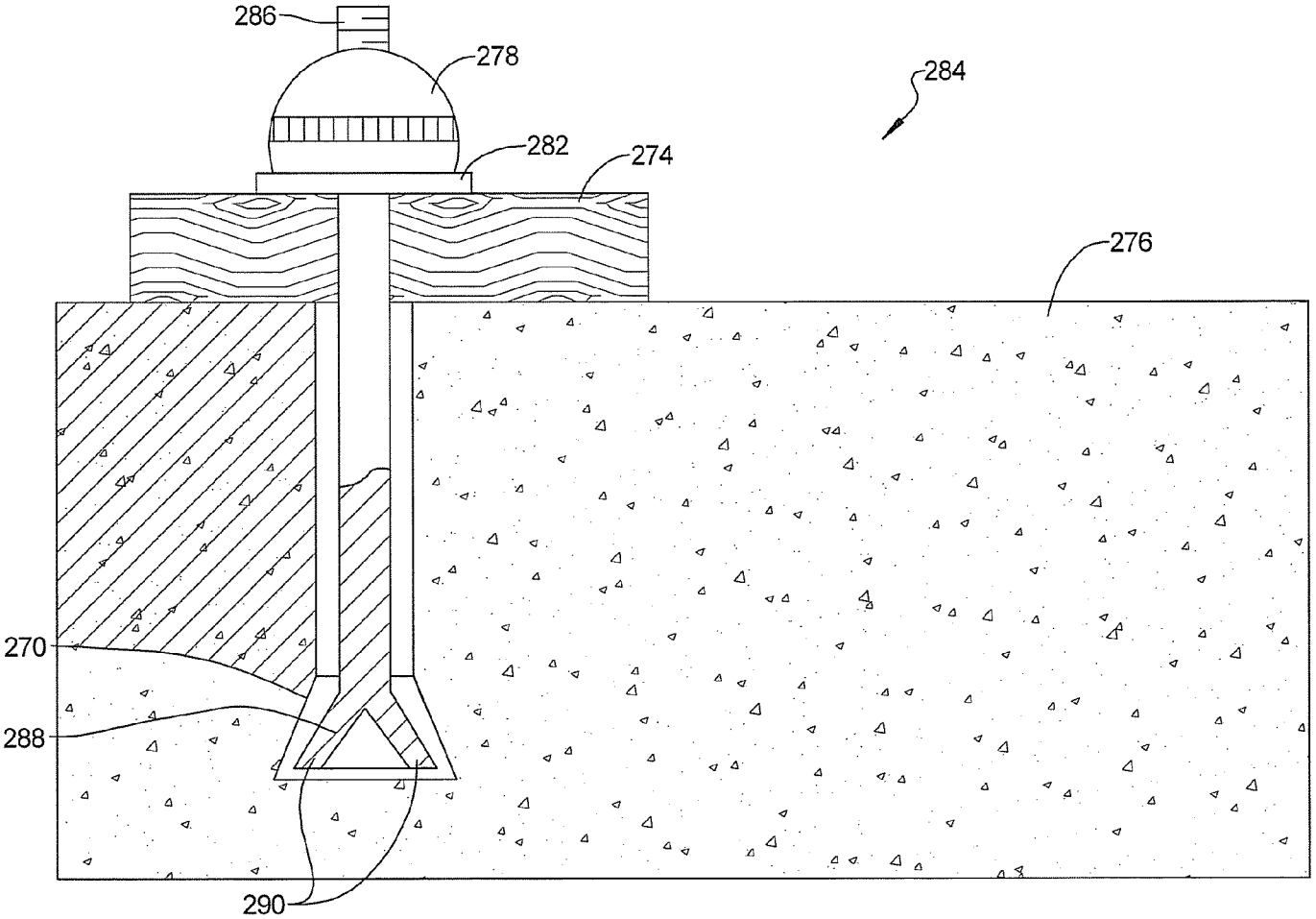
FIG. 26 is a partial cross sectional front elevational view similar to FIG. 25, of another embodiment for an anchor bolt device having a bell shaped bottom.
Figure 27:
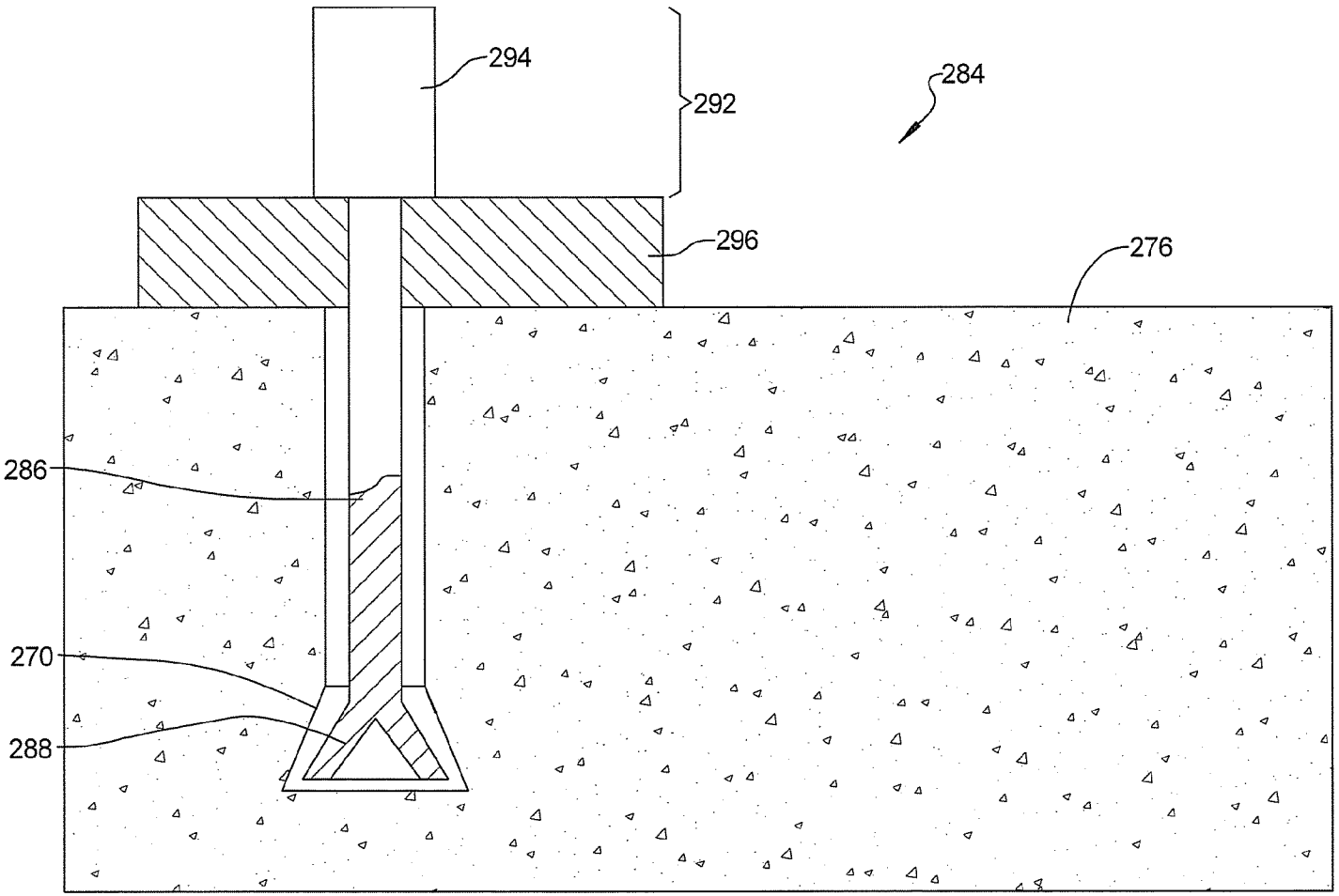
FIG. 27 is a partial cross sectional front elevational view similar to FIG. 26, of another embodiment for the bell shaped bottom anchor bolt device having a threaded anchor.

Referring to FIG. 27 and again to FIGS. 24-26, an alternative variation of this aspect provides the bell bottom anchor bolt 286 fastened to a cover plate assembly 292. The cover plate assembly 292 provides less loose parts. The cover plate assembly 292 also allows for a threaded tap or anchor 294 in a cover plate 296 or other fastening methods to facilitate various fastening applications.

Figure 28:
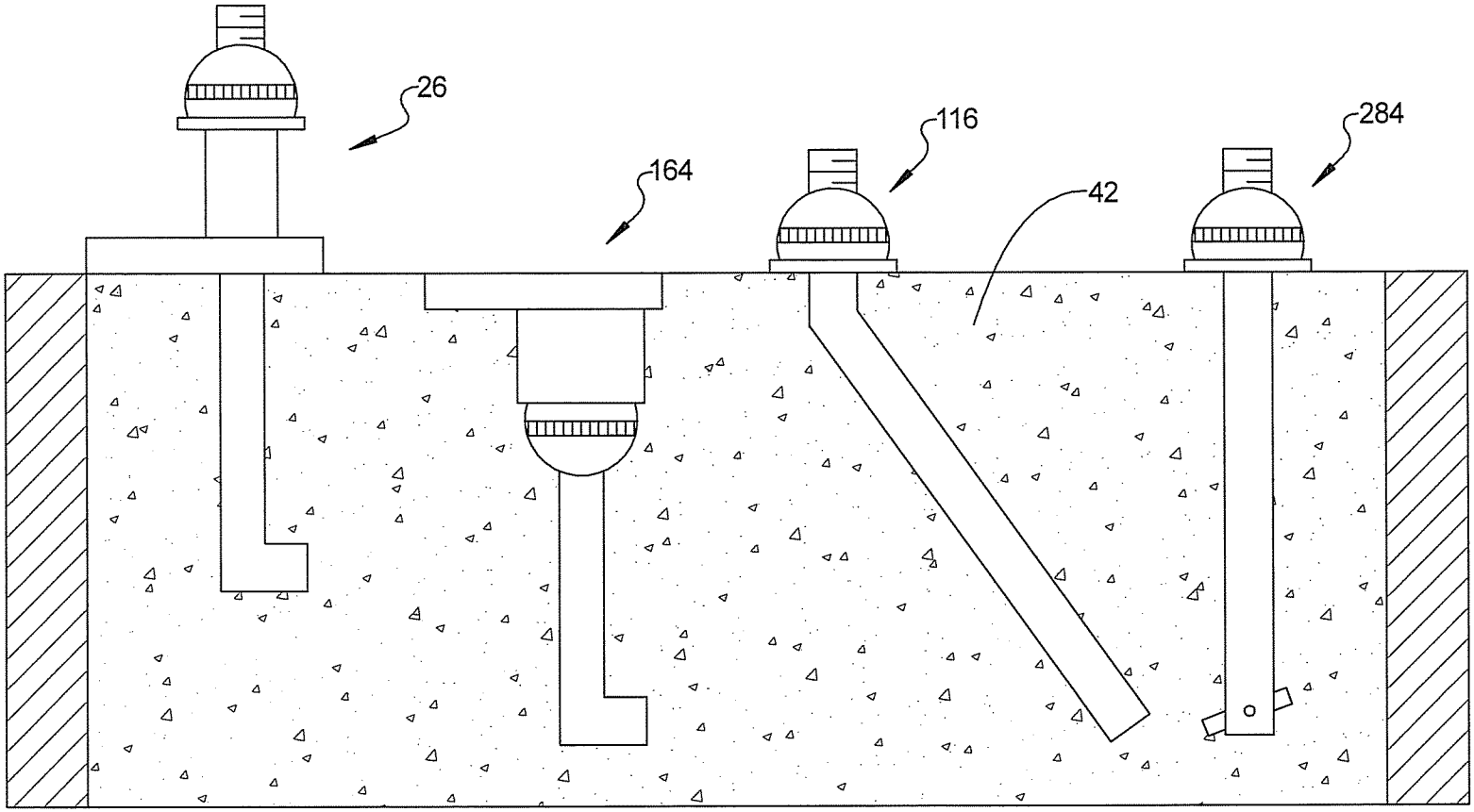
FIG. 28 is a partial cross sectional front elevational view similar to FIG. 3, showing the anchor bolt device embodiments of FIGS. 3, 11, 14 and 25 during installation into a concrete slurry.

Referring to FIG. 28 and again to FIGS. 1-27, each of the 26, 164, 116 and 284 are shown in relation to their installation in concrete slurry 42. Because each of the devices can be installed in concrete slurry 42, as the concrete slurry 42 hardens, the 26, 164, 116 and 284 devices all provide for alignment of a threaded portion of an anchor bolt for connection to a building structure, and retention of the anchor bolt when a force is applied tending to pull the anchor bolt out of the concrete.

Figure 29:
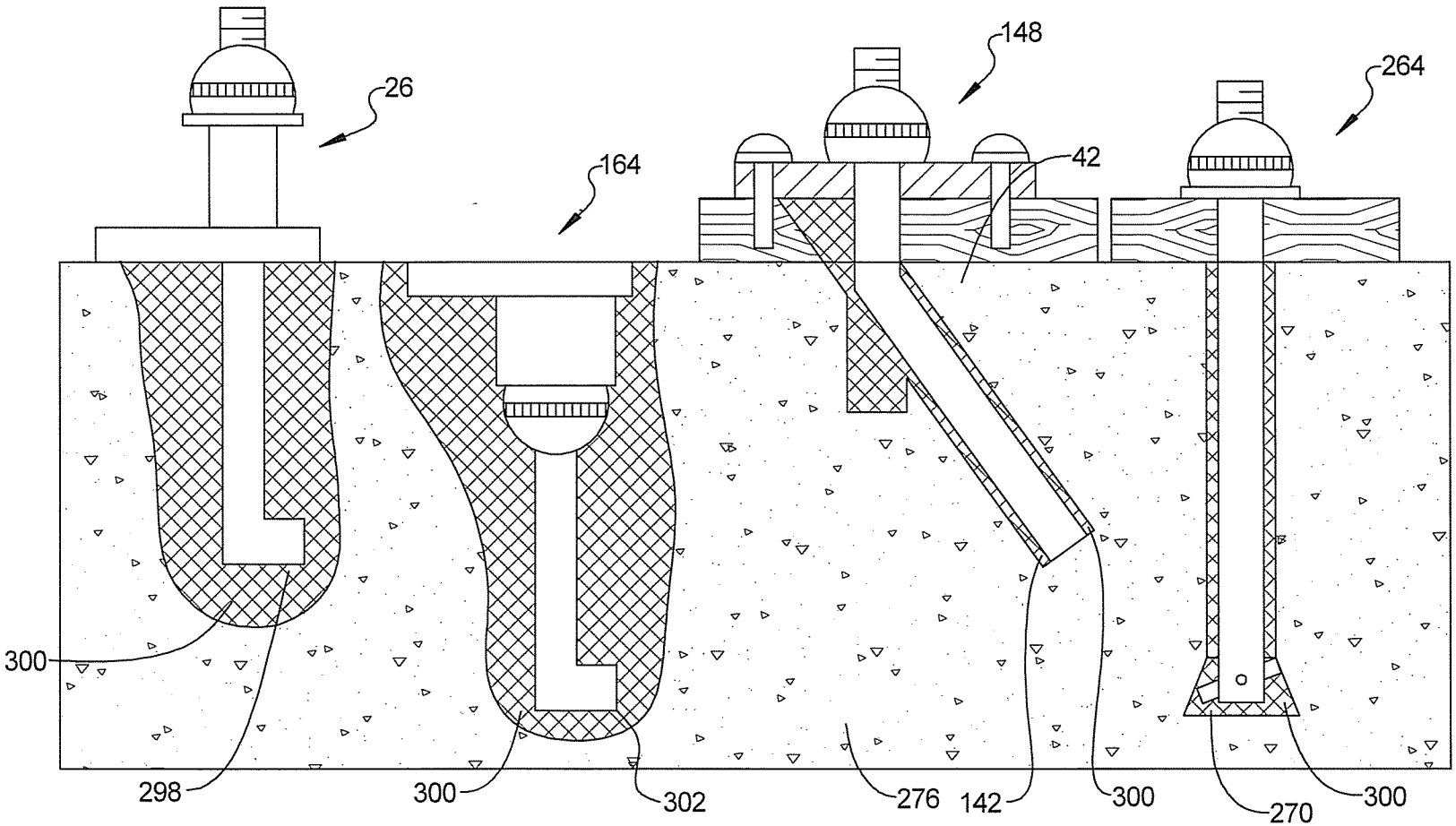
FIG. 29 is a partial cross sectional front elevational view similar to FIG. 28, showing the anchor bolt device embodiments of FIGS. 3, 11, 14 and 25 following installation into a solidified concrete foundation.

Referring to FIG. 29 and again to FIGS. 1-28, each of the 26, 164, 116 and 284 are shown in relation to their installation in a hardened concrete foundation. Because each of the devices can be installed in hardened concrete, a hole 298 used for installation of 26, a hole 302 used for installation of 164, a hole 142 used for installation of 148, and a hole 270 used for installation of 264 can each be backfilled with a curable filler 300. The 26, 164, 116 and 284 devices all provide for alignment of a threaded portion of an anchor bolt for connection to a building structure, and retention of the anchor bolt when a force is applied tending to pull the anchor bolt out of the concrete.

Figure 30:
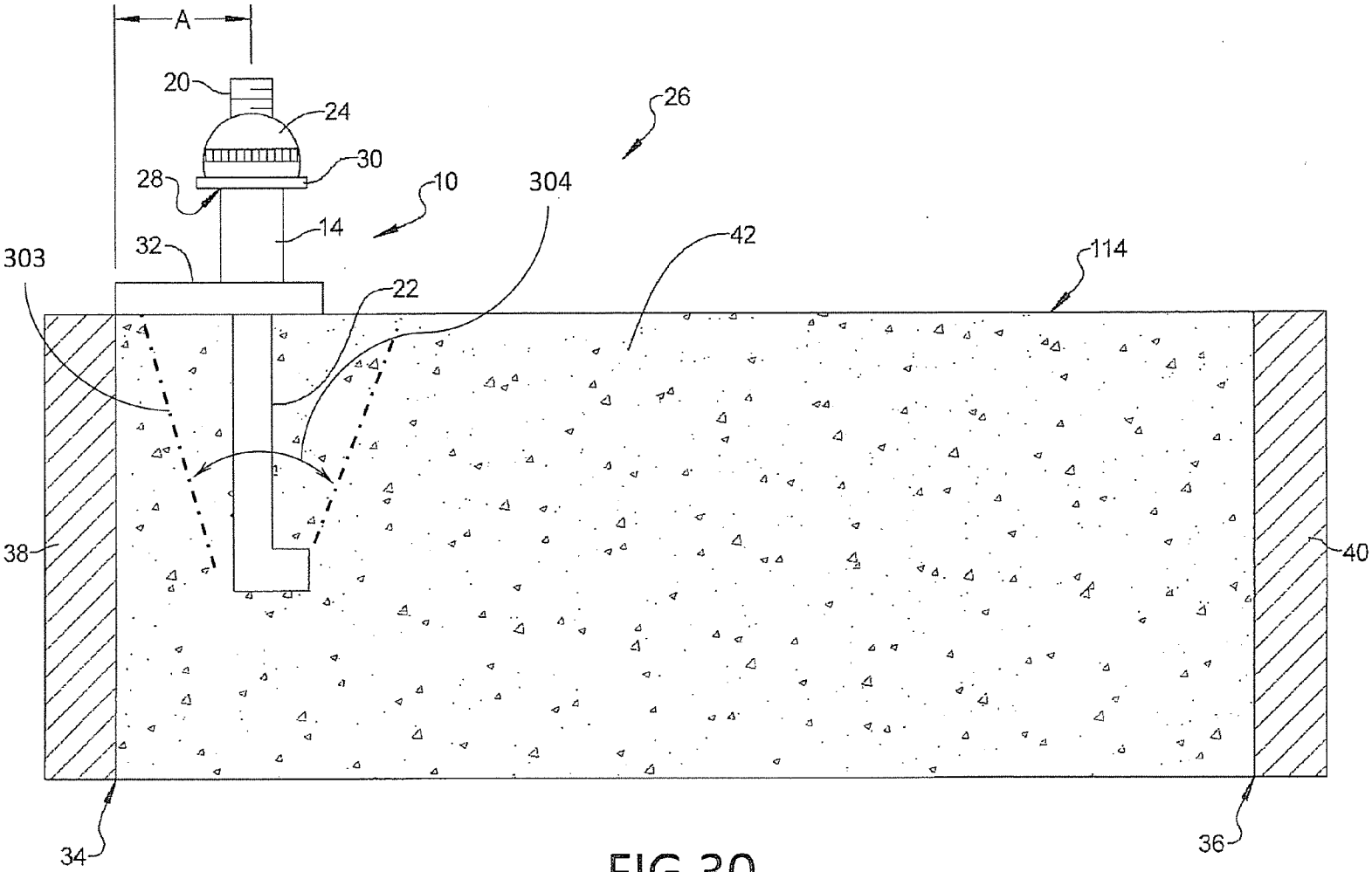
FIG. 30 is a partial cross sectional front elevational view showing the anchor bolt device embodiments of FIG. 3 overlaid with a schematic representation of a fracture cone.

Referring to FIG. 30, the boundaries of a fracture cone 303 is approximately defined by an included angle 304. Fracture cone 303 is depicted as typical for typical anchor bolt installations. The tail of anchor bolt 22 presents a relatively small retention area for the origin of the fracture cone. As a result, it is possible to pull-out an anchor bolt if the fracture cone breaks out of the concrete due to excess tensile force.

Figure 31:
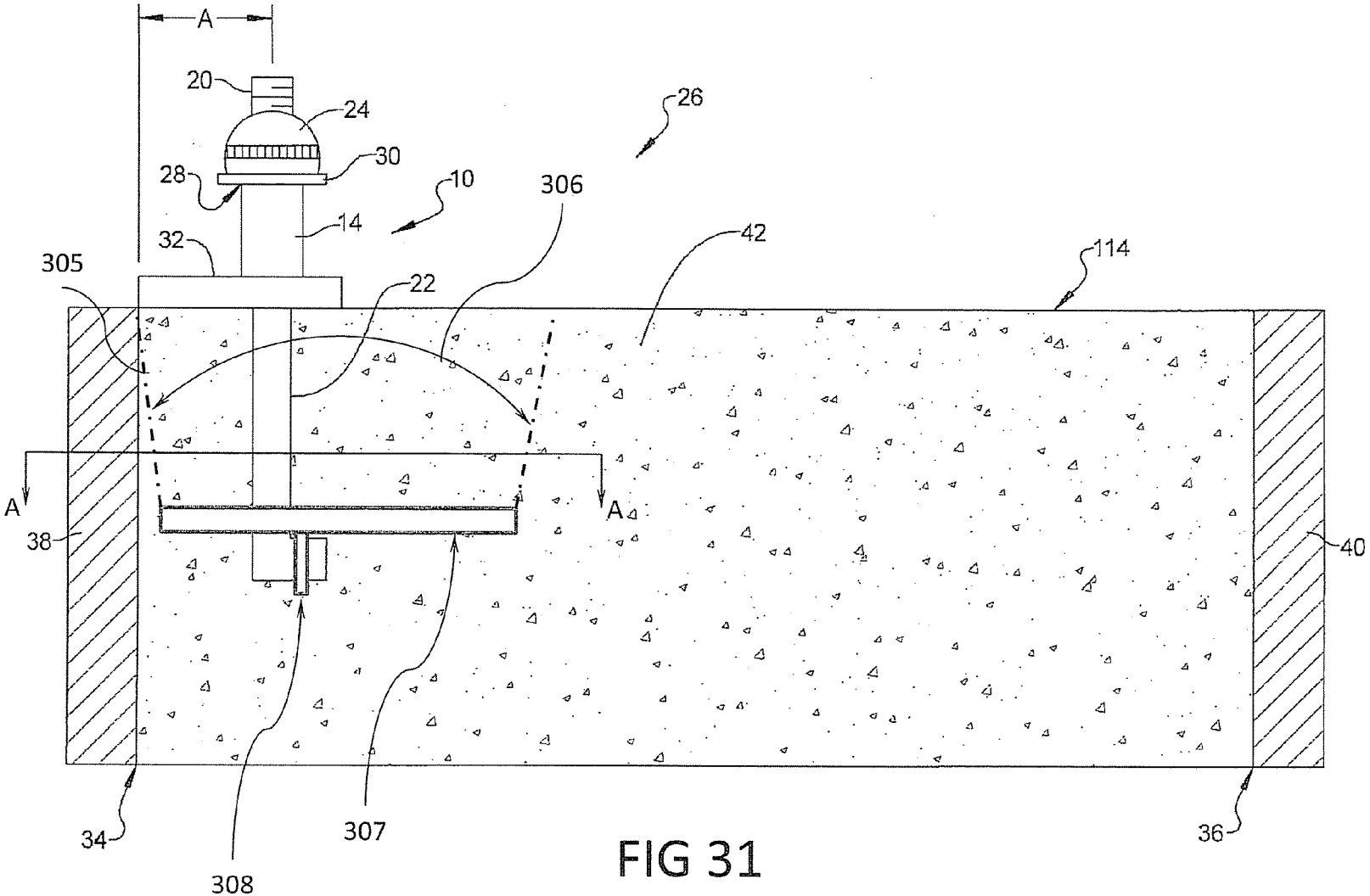
FIG. 31 is a partial cross sectional front elevation view similar to FIG. 30 with an anchor bolt assembly including a fracture cone enlargement device and FIG. 32 is section A-A taken from FIG. 31 showing a partial top view of a preferred embodiment of a fracture cone enlargement device.

Referring to FIG. 31, a fracture cone 305 is depicted enlarged compared to the fracture cone 303 depicted in FIG. 30. The boundaries of enlarged fracture cone 305 are approximately defined by an included angle 306. A fracture enlargement plate 307 straddles anchor bolt 22 and is retained to the tail of anchor bolt 22 by a portion 308. Compared to the typical fracture cone 303 shown in FIG. 30, the resulting enlarged fracture cone 305 provides improved resistance to pull-out of the anchor bolt.

Figure 32:
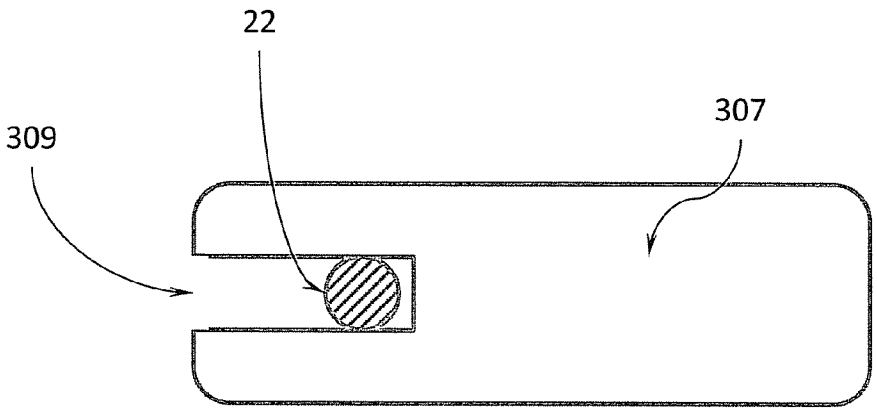

Referring to FIG. 32, one embodiment of a fracture cone enlargement plate 307 is shown with a receiving slot 309 to straddle the shaft of anchor bolt 22. Bent tail of anchor bolt 22 (not shown) is positioned on the underside of fracture cone enlargement plate 307 and cooperates with retainer portion 308 (not shown).

Referring again to FIGS. 30, 31, and 32, those skilled in the art will readily recognize and appreciate that the fracture cone enlargement plate 307 can be shaped in many different embodiments other than that shown so as to increase the retaining force of fracture cone originating from the fracture cone plate 307. In addition, a similar fracture enlargement cone can be adapted and applied to each of the anchor bolt variations included and referred to in this patent document, including applications wherein multiple anchor bolts are used such as depicted in FIGS. 5, 6, 18, and 19.

Improvements

The present disclosure provides an improved device and an improved method for orienting and positioning a typical anchor bolt via an assembly that is subsequently placed in previously poured uncured concrete slurry. The present disclosure includes a device with a flange portion and a raised column projection which cooperates with a typical anchor bolt by attaching to the threaded portion of the anchor bolt. The device is secured to the anchor bolt by using the standard anchor bolt nut to jam up against the device securing both the nut and the device fixed in place as an assembly. In most instances, a typical washer will be sandwiched between the nut and the device. The device provides convenient shipping and storing of the anchor bolt and the device and the associated nut and washer required for each installation. The device remains intact as it is placed in the concrete slurry and further remains assembled as the concrete cures. Once the concrete cures and hardens the nut and washer is removed leaving the device attached to the anchor bolt and secured in the concrete. A wall construction portion is fitted with an appropriate through hole positioned to receive the device over the anchor bolt and the device. The device will protrude above the concrete but will be recessed relative to the thickness of the assembled wall portion; the protrusion to be sufficiently recessed that the assembled nut on the protruding anchor bolt threads will not be able to ground out on the top end of the raised column projection. The anchor bolt will protrude above the concrete and protrude sufficiently above the assembled wall portion to allow reattachment of anchor bolt nut and washer.

Another improvement of the present disclosure is to provide an improved device for orienting and positioning a typical anchor bolt that positively threads onto a typical anchor bolt so that it is able to be firmly and securely jammed in place via a standard nut juxtaposed to the device on the threads of the anchor bolt. Another improvement of the present disclosure is to provide an improved device for orienting and positioning a typical anchor bolt that allows a typical washer to be securely sandwiched between a standard nut and the device and held assembled in place during storage, shipping, and installation, until such time the nut and washer are removed in order to install a wall construction to the anchor bolt.

Another improvement of the present disclosure is to provide an improved device for orienting and positioning a typical anchor bolt such that the assembly of the device and jammed nut provide a protective shield for the threads against incidental damage during shipping and handling and storage. Another improvement of the present disclosure is to provide an improved device for orienting and positioning a typical anchor bolt such that the assembly of the device and jammed nut provide a protective shield for the threads during placement of the device in concrete slurry.

Another improvement of the present disclosure is to provide an improved device for orienting and positioning a typical anchor bolt such that the assembly of the device and jammed nut provide a protective shield for the threads while the concrete slurry is being surface finished so that slurry is not introduced to the threads. Another improvement of the present disclosure is to provide an improved device for orienting and positioning a typical anchor bolt such that the assembly of the device provides a defined offset distance from a form at the boundary of the concrete. The offset distance is not fastened to the form which allows the user to position the device freely in the slurry.

Another improvement of the present disclosure is to provide an improved device for orienting and positioning a typical anchor bolt such that the device can be positioned in the concrete slurry substantially away from the boundary forms and does not require an attached template means. Another improvement of the present disclosure is to provide an improved device for orienting and positioning a typical anchor bolt such that one preferred embodiment of the device features two offset tabs set predominately at right angles with respect to each other. One offset tab extends in the same general plane as the flange portion and is set at a defined length so as to position the anchor bolt in the approximate center of a 2"×4" wall construction. The other offset tab extends in the same general plane as the flange portion and is set at predominately a right angle from the first offset tab. The second offset tab is set at a defined length so as to position the anchor bolt in the approximate center of a 2"×6" wall construction.

Another improvement of the present disclosure is to provide an improved device for orienting and positioning a typical anchor bolt such that one preferred embodiment of the device features a relatively long offset tab extending in the same general plane as the flange portion. The tab has demarcations and/or easy break-off features to allow the user to break off portions of the length of the offset tab to establish a user defined offset distance for the device from a concrete form or other object when the device is placed in the slurry.

Another improvement of the present disclosure is to provide an improved device for orienting and positioning a typical anchor bolt such that one preferred embodiment of the device features multiple anchor bolts arrayed in a single device. The anchor bolt array can be a linear array of two or more anchor bolts, a rectangular or square array of at least four anchor bolts, a triangular array of at least three anchor bolts, a circular array of at least three anchor bolts, or any one of a plethora of other array patterns.

Another improvement of the present disclosure is to provide an improved method for orienting and positioning a typical anchor bolt in concrete slurry by providing a device that facilitates use of a 3-axis gimbal defined by a first axis of relative vertical rotation (yaw) and a second axis of relative lateral rotation (pitch) and a third axis of relative longitudinal rotation (roll). Another improvement of the present disclosure is to provide an improved method for orienting and positioning a typical anchor bolt in concrete slurry by providing a device that facilitates use of a 3-axis gimbal defined by a first axis of relative vertical rotation (yaw) and a second axis of relative lateral rotation (pitch) and a third axis of relative longitudinal rotation (roll). The gimbals provide the user with the ability to establish a generally perpendicular orientation of the subject device relative to the surface of the concrete slurry. The gimbals also provide the user with the ability to establish a user defined generally non-perpendicular orientation of the subject device relative to the surface of the concrete slurry.

Another improvement of the present disclosure is to provide an improved method for orienting and positioning a typical anchor bolt in concrete slurry by providing a device that features a relative vertical adjustment of the relative linear position of the device and the anchor bolt, the adjustment is independent of the 3-axis gimbal feature and allows the user to establish a user defined depth in the slurry and/or exposed thread protrusion of the anchor bolt. Another improvement of the present disclosure is to provide an improved method for orienting and positioning a typical anchor bolt in concrete slurry by providing a device that features a relative rotational adjustment revolved about the centerline of the relative vertical adjustment of the relative linear position of the device of the anchor bolt, the adjustment is independent of the 3-axis gimbal feature and allows the user to establish a user defined position of the bent tail of the anchor bolt in the slurry such that the bent tail of a typical anchor bolt can be oriented in any direction of a 360° rotation. The user defined oriented position of the anchor bolt bent tail is set prior to insertion of the device into the concrete slurry. The relative oriented relationship of the position of the offset tab and the bent anchor tail provides the user with a visible reference of the bent tail submerged out of sight in the slurry by observing the position of the offset tail of the device visible on the surface of the slurry.

A further improvement of the present disclosure is to provide a device and method for orienting and positioning a skewed anchor bolt in cured concrete. The subject invention includes a skewed anchor bolt, a cover plate, and a typical anchor bolt nut. The skewed anchor bolt system may include any one of several methods acceptable to secure the cover plate to wall plate constructions. A further improvement of the present disclosure is to provide a device for orienting and positioning a skewed anchor bolt so that it is able to be positioned skewed with the surface of the concrete such that it cannot rotate during tightening of the anchor bolt nut.

A further improvement of the present disclosure is to provide a skewed anchor bolt system that does not require epoxy or other adhesive methods to secure the anchor bolt in place against pull-out and/or against rotation. An additional improvement of the present disclosure is to provide a device and method for orienting and positioning a typical anchor bolt via a device that is subsequently placed in previously poured uncured concrete slurry.

An additional improvement of the present disclosure is to provide a device for orienting and positioning a typical anchor bolt such that the assembly of the device provides a defined offset distance from a form at the boundary of the concrete. The offset distance is not fastened to the form which allows the user to position the device freely in the slurry. An additional improvement of the present disclosure is to provide a device for orienting and positioning a flush anchor bolt such that the device can be positioned in the concrete slurry substantially away from the boundary forms and does not require an attached template means.

An additional improvement of the present disclosure is to provide a device for orienting and positioning a typical anchor bolt that allows an orientation device to be sandwiched between a standard coupling nut and typical anchor bolt nut and held assembled in place during storage, shipping, and installation, until such time the detachable plug is removed in order to install a wall construction to the flush anchor bolt.

An additional improvement of the present disclosure is to provide a device for orienting and positioning a flush anchor bolt such that one preferred embodiment of the device features two offset tabs 208, 210 set predominately at right angles with respect to each other (modified from the parallel configuration shown in FIG. 18). One offset tab 208 extends in the same general plane as the flange portion 198 and is set at a defined length so as to position the flush anchor bolt in the approximate center of a 2"×4" wall construction. The other offset tab 210 extends in the same general plane as the flange portion 200 and is set at predominately a right angle from the first offset tab 208. The second offset tab 210 is set at a defined length so as to position the flush anchor bolt in the approximate center of a 2"×6" wall construction.

An additional improvement of the present disclosure is to provide a device for orienting and positioning a flush anchor bolt such that one preferred embodiment of the device features a relatively long offset tab extending in the same general plane as the flange portion. The tab has demarcations and/or easy break-off features to allow the user to break off portions of the length of the offset tab to establish a user defined offset distance for the device from a concrete form or other object when the device is placed in the slurry. An additional improvement of the present disclosure is to provide a device for orienting and positioning a flush anchor bolt such that one preferred embodiment of the device features multiple flush anchor bolts arrayed in a single device. The flush anchor bolt array can be a linear array of two or more flush anchor bolts, a rectangular or square array of at least four flush anchor bolts, a triangular array of at least three flush anchor bolts, a circular array of at least three flush anchor bolts, or any one of a plethora of other array patterns.

An additional improvement of the present disclosure is to provide a method for orienting and positioning a flush anchor bolt in concrete slurry by providing a device that facilitates use of a 3-axis gimbal defined by a first axis of relative vertical rotation (yaw) and a second axis of relative lateral rotation (pitch) and a third axis of relative longitudinal rotation (roll). An additional improvement of the present disclosure is to provide a method for orienting and positioning a typical anchor bolt in concrete slurry by providing a device that facilitates use of a 3-axis gimbal defined by a first axis of relative vertical rotation (yaw) and a second axis of relative lateral rotation (pitch) and a third axis of relative longitudinal rotation (roll). The gimbals provide the user with the ability to establish a generally perpendicular orientation of the subject device relative to the surface of the concrete slurry. The gimbals also provide the user with the ability to establish a user defined generally non-perpendicular orientation of the subject device relative to the surface of the concrete slurry.

An additional improvement of the present disclosure is to provide a method for orienting and positioning a flush anchor bolt in concrete slurry by providing a device that features a relative vertical adjustment of the relative linear position of the surface of the slurry and the anchor bolt, the adjustment is independent of the 3-axis gimbal feature and allows the user to establish a user defined depth in the slurry. An additional improvement of the present disclosure is to provide a method for orienting and positioning a flush anchor bolt in concrete slurry by providing a device that features a relative rotational adjustment revolved about the centerline of the relative vertical adjustment of the relative linear position of the device of the flush anchor bolt, the adjustment is independent of the 3-axis gimbal feature and allows the user to establish a user defined position of the bent tail of the flush anchor bolt in the slurry such that the bent tail of a typical anchor bolt can be oriented in any direction of a 360° rotation. The user defined oriented position of the anchor bolt bent tail is set prior to insertion of the device into the concrete slurry. The relative oriented relationship of the position of the offset tab and the bent anchor tail provides the user with a visible reference of the bent tail submerged out of sight in the slurry by observing the position of the offset tail of the device visible on the surface of the slurry.

An additional improvement of the present disclosure is to provide a device and method for orienting and positioning a bell bottom anchor bolt in cured concrete or heavy slurry. The subject invention includes a bell bottom anchor bolt and a typical anchor bolt nut, and in most cases a typical washer. The bell bottom anchor bolt system includes any one of several methods acceptable to drill holes in concrete and to further provide a widened area at the bottom of the hole. Another improvement of the subject invention is to provide a device for orienting and positioning a bell bottom anchor bolt so that it is able to be positioned with the surface of the concrete such that it cannot rotate during tightening of the anchor bolt nut. Another improvement of the subject invention is to provide a bell bottom anchor bolt system that does not require epoxy or other adhesive methods to secure the anchor bolt in place against pull-out and/or against rotation.

An additional improvement of the present disclosure is to provide a fracture cone enlargement device wherein a fracture cone enlargement plate is fixed to the tail of an anchor bolt and/or fixed and interconnected between tails of multiple adjacent anchor bolts so as to establish an enlarged fracture cone than is possible by the tail of an anchor bolt by itself.

Those skilled in the art will readily recognize and appreciate additional features and advantages inherent in the subject invention device and method beyond those articulated in this disclosure. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An anchor bolt device for connecting a wall plate construction to a concrete foundation, comprising:

an anchor bolt extending between a threaded first end and a second end that is opposite the threaded first end; and a flange portion that is permanently disposed about the threaded first end of the anchor bolt when the wall plate construction is installed on the concrete foundation, the flange portion defining a planar surface aligned in parallel with a surface of the concrete foundation when the second end of the anchor bolt is received in the concrete foundation, the flange portion including at least one offset tab extending outwardly away from the anchor bolt to define an offset distance, the flange portion further including a raised column projection having a threaded portion through which the threaded first end of the anchor bolt is threadably received, the raised column projection extending a pre-determined height above the planar surface of the flange portion, the pre-determined height of the raised column projection configured to be less than a thickness of the wall plate construction such that the flange portion remains in threaded engagement with the threaded first end of the anchor bolt after the concrete foundation has cured and the wall plate construction is installed on the concrete foundation without the raised column projection interfering with connection of the wall plate construction to the anchor bolt.

2. The anchor bolt device of claim 1, wherein the raised column projection is set to a user defined position relative to the anchor bolt.

3. The anchor bolt device of claim 1, further comprising:

an anchor bolt nut that extends radially beyond the raised column projection such that the anchor bolt nut can be tightened against the wall plate construction.

4. The anchor bolt device of claim 1, wherein the flange portion extends radially outward from and is integrally connected to the raised column projection, the at least one offset tab having multiple frangible break points allowing a user to break off a portion of the at least one offset tab at one of the multiple frangible break points to shorten the offset distance of the at least one offset tab.

5. The anchor bolt device of claim 4, wherein the multiple break points of the at least one offset tab are a series of discontinuities extending inwardly into the at least one offset tab weakening the at least one offset tab at the multiple break points and allowing a user to remove a portion of the at least one offset tab by breaking the at least one offset tab at one of the multiple break points to establish a reduced offset distance.

6. The anchor bolt device of claim 1, wherein the raised column projection and the anchor bolt are arranged in a pre-assembled condition with an anchor bolt nut tightened against an end of the raised column projection preventing further relative movement of the raised column projection with respect to the anchor bolt prior to and during the second end of the anchor bolt being received in the concrete foundation.

7. The anchor bolt device of claim 6, further including an anchor bolt washer sandwiched between the anchor bolt nut and the end of the raised column projection, the anchor bolt washer configured to be kept in place between the anchor bolt nut and the raised column projection throughout shipping, storage, installation, and final attachment of a wall structure.

8. The anchor bolt device of claim 1, wherein the anchor bolt has a tail disposed at the second end and a fracture cone enlargement plate that is fixed to the tail of the anchor bolt.

9. The anchor bolt device of claim 8, wherein the fracture cone enlargement plate further includes a retainer portion fixing the fracture cone enlargement plate to the tail of the anchor bolt.

10. The anchor bolt device of claim 1, wherein the flange portion extends radially outwardly with respect to the anchor bolt and wherein the at least one offset tab is used to position the anchor bolt device the offset distance away from a boundary of a concrete foundation wall.

11. An anchor bolt device for connecting a wall plate construction to a concrete foundation wherein the wall plate construction has a thickness and at least one bore that extends through the thickness of the wall plate construction, the anchor bolt device comprising:

an anchor bolt extending between a threaded first end and a second end that is opposite the threaded first end, the threaded first end configured to extend through the at least one bore of the wall plate construction and the second end configured to be received in the concrete foundation;

an anchor bolt nut threadably received on the threaded first end of the anchor bolt such that the wall plate construction is configured to be held between the concrete foundation and the anchor bolt nut; and a flange portion disposed about the threaded first end of the anchor bolt, the flange portion including at least one offset tab extending outwardly away from the anchor bolt to define an offset distance, the flange portion further including a raised column projection having a threaded portion through which the threaded first end of the anchor bolt is threadably received, the raised column projection configured to extend into the at least one bore of the wall plate construction and be positioned in the at least one bore radially between the threaded first end of the anchor bolt and the wall plate construction, the raised column projection extending a pre-determined height above the planar surface of the flange portion, the pre-determined height of the raised column projection configured to be less than the thickness of the wall plate construction such that the threaded portion remains in threaded engagement with the threaded first end of the anchor bolt without the raised column projection interfering with the anchor bolt nut as the anchor bolt nut is tightened against the wall plate construction.

12. The anchor bolt device of claim 11, wherein the anchor bolt nut extends radially beyond the raised column projection such that the anchor bolt nut can be tightened against the wall plate construction.

13. The anchor bolt device of claim 11, wherein the at least one offset tab has multiple frangible break points allowing a user to break off a portion of the at least one offset tab at one of the multiple frangible break points to shorten the offset distance of the at least one offset tab.

14. The anchor bolt device of claim 13, wherein the multiple break points of at least one offset tab are a series of discontinuities extending inwardly into the at least one offset tab weakening the at least one offset tab at the multiple break points and allowing a user to remove a portion of the at least one offset tab by breaking the at least one offset tab at one of the multiple break points to establish a reduced offset distance.

15. The anchor bolt device of claim 11, wherein the raised column projection and the anchor bolt are arranged in a pre-assembled condition with the anchor bolt nut tightened against an end of the raised column projection preventing further relative movement of the raised column projection with respect to the anchor bolt prior to and during the second end of the anchor bolt being received in the concrete foundation.

16. The anchor bolt device of claim 11, further including an anchor bolt washer sandwiched between the anchor bolt nut and the end of the raised column projection, the anchor bolt washer configured to be kept in place between the anchor bolt nut and the raised column projection throughout shipping, storage, installation, and final attachment of a wall structure.

17. The anchor bolt device of claim 11, wherein the anchor bolt has a tail disposed at the second end and a fracture cone enlargement plate that is fixed to the tail of the anchor bolt.

18. The anchor bolt device of claim 17, wherein the fracture cone enlargement plate further includes a retainer portion fixing the fracture cone enlargement plate to the tail of the anchor bolt.

19. The anchor bolt device of claim 11, wherein the flange portion extends radially outwardly with respect to the anchor bolt and wherein the at least one offset tab is used to position the anchor bolt device the offset distance away from a boundary of a concrete foundation wall.

20. The anchor bolt device of claim 11, wherein the at least one offset tab of the flange portion is configured to abut and be disposed between the wall plate construction and the concrete foundation.

21. An anchor bolt device for connecting a wall plate construction to a concrete foundation, comprising:

an anchor bolt extending between a threaded first end and a second end that is opposite the threaded first end; and a flange portion that is permanently disposed about the threaded first end of the anchor bolt when the wall plate construction is installed on the concrete foundation, the flange portion defining a planar surface aligned in parallel with a surface of the concrete foundation when the second end of the anchor bolt is received in the concrete foundation, the flange portion including at least one offset tab extending outwardly away from the anchor bolt to define an offset distance, the raised column projection having a threaded portion through which the threaded first end of the anchor bolt is threadably received, the raised column projection extending a pre-determined height above the planar surface of the flange portion, the pre-determined height of the raised column projection being less than 1.5 inches such that the raised column projection does not interfere with connection of the wall plate construction to the anchor bolt.

* * * * *